US010556420B2

(12) United States Patent
Perrier

(10) Patent No.: US 10,556,420 B2
(45) Date of Patent: Feb. 11, 2020

(54) MEASURING AND CORRECTING PRINT-TO-PRINT REGISTER OF A MULTICOLOUR PRINT FORMED ON PRINTED MATERIAL

(71) Applicant: KBA-NOTASYS SA, Lausanne (CH)

(72) Inventor: Jacques Perrier, Commugny (CH)

(73) Assignee: KBA-NOTASYS SA, Lausanne (CH)

( * ) Notice: Subject to any disclaimer, the term of this patent is extended or adjusted under 35 U.S.C. 154(b) by 0 days.

(21) Appl. No.: 16/086,130

(22) PCT Filed: May 19, 2017

(86) PCT No.: PCT/IB2017/052969

§ 371 (c)(1),
(2) Date: Sep. 18, 2018

(87) PCT Pub. No.: WO2017/199216

PCT Pub. Date: Nov. 23, 2017

(65) Prior Publication Data

US 2019/0337285 A1 Nov. 7, 2019

(30) Foreign Application Priority Data

May 19, 2016 (EP) ..... 16170496

(51) Int. Cl.
*B41F 13/12* (2006.01)
*B41F 11/02* (2006.01)

(52) U.S. Cl.
CPC ..... *B41F 13/12* (2013.01); *B41F 11/02* (2013.01)

(58) Field of Classification Search
CPC ..... B41F 13/12
(Continued)

(56) References Cited

U.S. PATENT DOCUMENTS 5,974,967 A * 11/1999 Bravenec ..... B41F 13/14 101/183
6,101,939 A 8/2000 Giori et al.
(Continued)

FOREIGN PATENT DOCUMENTS

DE 20 2011 109 630 2/2012
EP 0 2660 057 11/2013
(Continued)

OTHER PUBLICATIONS

International Search Report for PCT/IB2017/052969, dated Sep. 12, 2017, 3 pages.
(Continued)

*Primary Examiner* — Anthony H Nguyen
(74) *Attorney, Agent, or Firm* — Nixon & Vanderhye P.C.

(57) ABSTRACT

There is described a process of measuring print-to-print register of a multicolour print (A-D) provided in an effective printed area (EPA) of the surface of printed material, which multicolour print (A-D) is formed on the printed material by means of one or more printing presses and includes at least a first pattern (A) and a second pattern (B) distinguishable from the first pattern (A), the effective printed area (EPA) being provided with a matrix arrangement of individual imprints (P) which are each provided with the multicolour print (A-D) and are repeated over the surface of the effective printed area (EPA) along a pattern of rows and columns. Measurement of an actual print-to-print register between the first and second patterns (A, B), as reflected on the printed material, is derived from processing and finding a correspondence between (i) at least one sample image ($SI_A$, $SI_B$) of the printed material covering at least a portion of the first and second patterns (A, B), and (ii) at least one corresponding reference image ($RI_A$, $RI_B$) generated using prepress design data of the first and second patterns (A, B). Furthermore, the process is repeated for multiple ones of the
(Continued)

individual imprints (P) so as to derive a set of multiple measurements of the actual print-to-print register between the first and second patterns (A, B) at various imprint locations over the effective printed area (EPA), which set of multiple measurements is mapped into a corresponding print-to-print register map ($M_{B-A}$, $M_{C-A}$, $M_{D-A}$, . . . ) that is representative of print-to-print register deviations at the various imprint locations. Also described is a measuring device for carrying out this process and a process of measuring and correcting print-to-print register of a multicolour print.

12 Claims, 24 Drawing Sheets

(58) Field of Classification Search
USPC ..... 101/485
See application file for complete search history.

(56) References Cited

U.S. PATENT DOCUMENTS 6,895,862 B1* 5/2005 Ben-Chorin ..... B41F 27/005 101/181
2002/0178952 A1* 12/2002 Sainio ..... B41F 33/0081 101/485
2004/0163562 A1* 8/2004 Lewis, Jr. ..... B41F 33/0081 101/485
2005/0199151 A1 9/2005 Holten et al.
2010/0236432 A1* 9/2010 Foresti ..... B41F 9/021 101/167
2011/0265676 A1* 11/2011 Golan ..... B41F 13/14 101/485
2014/0132694 A1* 5/2014 Shacham ..... H04N 1/00883 347/110
2015/0088477 A1* 3/2015 Perrier ..... B41M 3/14 703/6
2015/0221077 A1* 8/2015 Kawabata ..... G06T 7/001 382/141

FOREIGN PATENT DOCUMENTS

EP 2 998 117 3/2016
WO 2007/042919 4/2007
WO 2007/105059 9/2007
WO 2012/131581 10/2012
WO 2013/001009 1/2013
WO 2013/001010 1/2013
WO 2013/001518 1/2013
WO 2013/132448 9/2013

OTHER PUBLICATIONS

International Preliminary Report on Patentability with Amended Sheets, dated Sep. 3, 2018, 22 pages.

* cited by examiner

FIRST SAMPLE IMAGE ($SI_A$) :
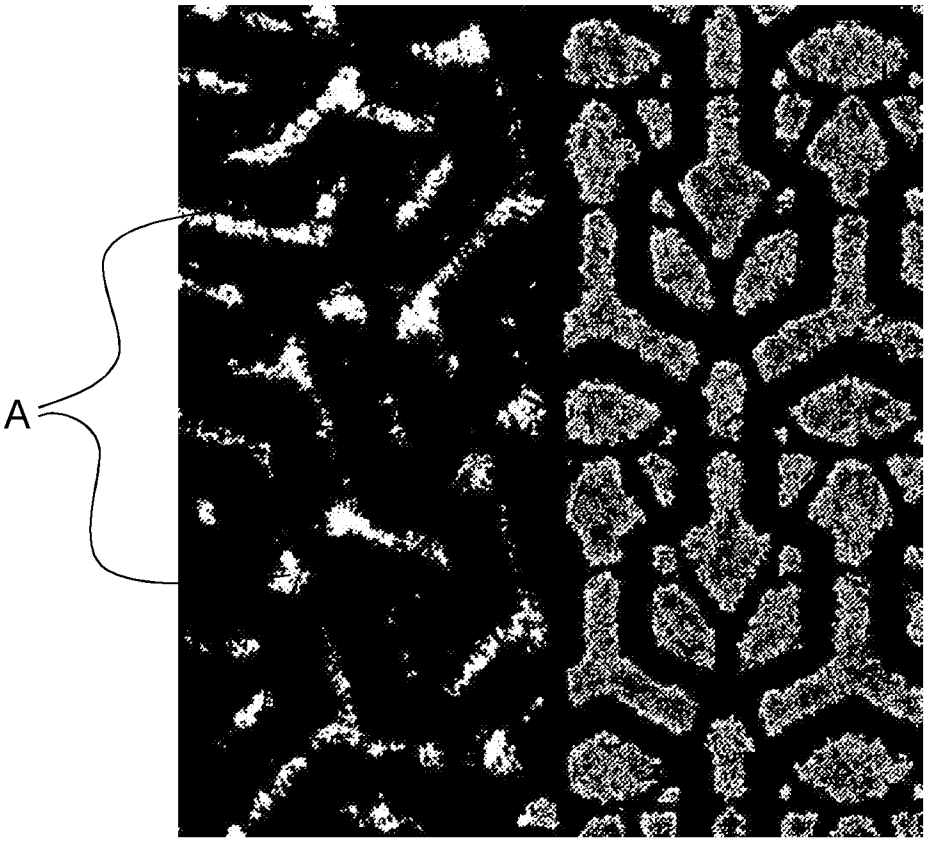
Fig. 9
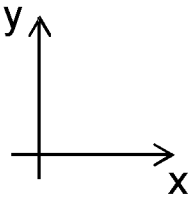

SECOND SAMPLE IMAGE ($SI_B$) :
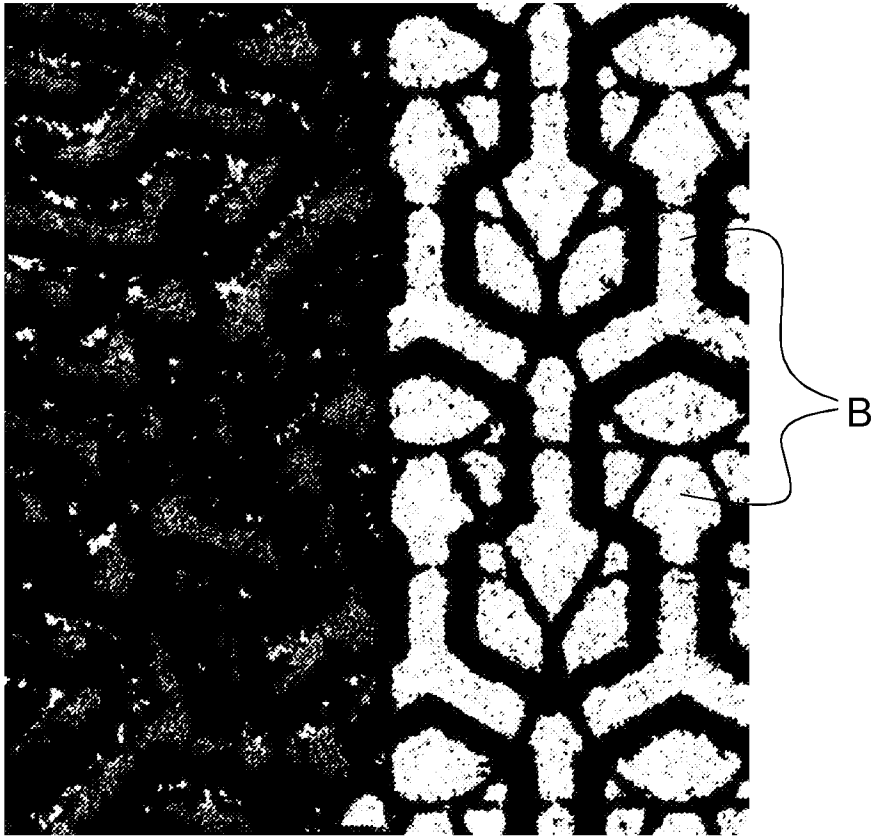
Fig. 10
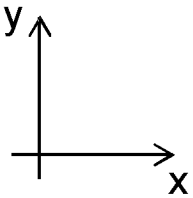

PREPRESS DESIGN DATA SHOWING FIRST AND SECOND PATTERNS (A, B) WITH DESIRED PRINT-TO-PRINT REGISTER :

FIRST REFERENCE IMAGE ($RI_A$) OF FIRST PATTERN (A):

PREPRESS DESIGN DATA OF SECOND PATTERN (B):
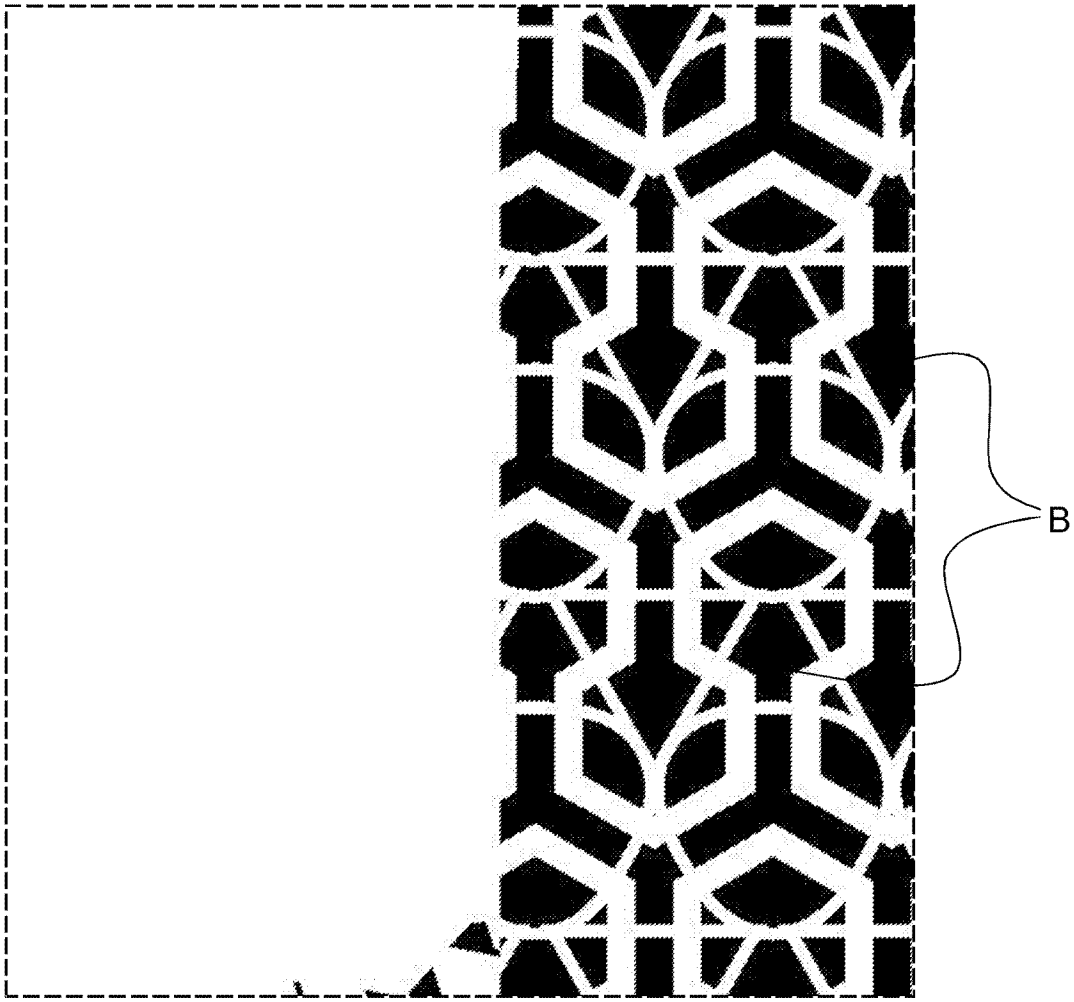
Fig. 14
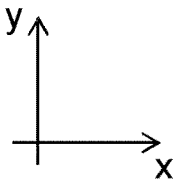

SECOND REFERENCE IMAGE ($RI_B$) OF SECOND PATTERN (B):
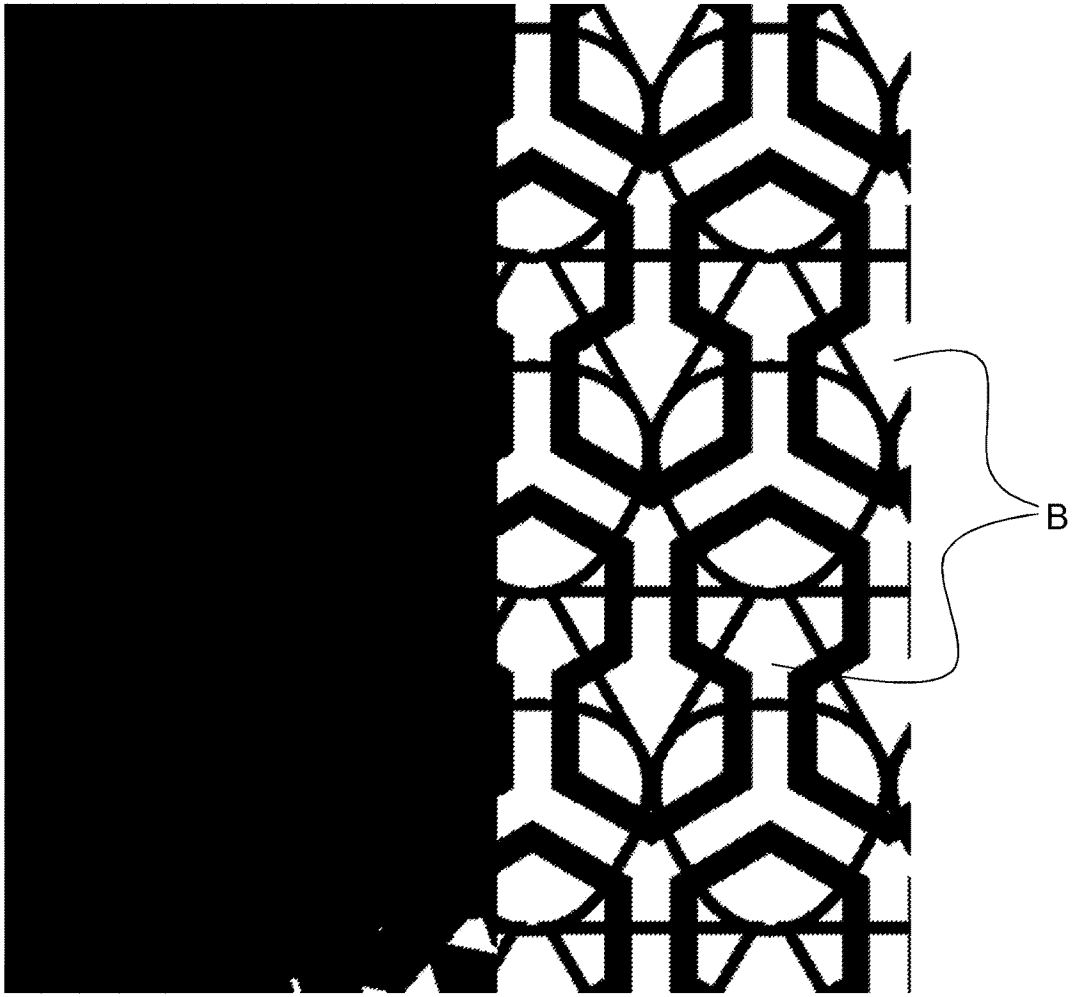
Fig. 15
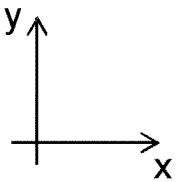

FINDING CORRESPONDANCE BETWEEN FIRST REFERENCE IMAGE ($RI_A$) AND FIRST SAMPLE IMAGE ($SI_A$) :

FINDING CORRESPONDANCE BETWEEN SECOND REFERENCE IMAGE ($RI_B$) AND SECOND SAMPLE IMAGE ($PI_B$) :

MEASURING AND CORRECTING PRINT-TO-PRINT REGISTER OF A MULTICOLOUR PRINT FORMED ON PRINTED MATERIAL

This application is the U.S. national phase of International Application No. PCT/M2017/052969 filed 19 May 2017, which designated the U.S. and claims priority to EP Patent Application No. 16170496.0 filed 19 May 2016, the entire contents of each of which are hereby incorporated by reference.

TECHNICAL FIELD

The present invention generally relates to the measurement of print-to-print register of a multicolour print, which multicolour print is formed on printed material by means of one or more printing presses and includes at least a first pattern and a second pattern distinguishable from the first pattern. The present invention is in particular applicable in the context of the production of security documents, such as banknotes. More precisely, the present invention relates to a process of measuring print-to-print register of such a multicolour print, a measuring device to carry out the same, as well as a process of measuring and correcting such print-to-print register.

BACKGROUND OF THE INVENTION

Measurement of print-to-print register of a multicolour print (also sometimes referred to as "colour register measurement") is known as such in the art. Such measurement is in particular carried out in the context of multicolour offset printing where the multicolour print typically consists of multiple offset-printed patterns which are juxtaposed on the printed material using multiple printing plates.

Measurement of print-to-print register is not only of interest in the context of one and a same printing process, such as offset printing, but also when the printed material is subjected to different printing processes. Such is the case in the context of the production of security documents, like banknotes, which are typically subjected to multiple printing phases, in particular offset printing and intaglio printing. In this context, it is also of interest to assess and to be in a position to measure and, as the case may be, to correct the print-to-print register between e.g. the offset print and the intaglio print as the relevant print-to-print register has to be kept within acceptable tolerances to meet certain quality requirements.

Print-to-print register is typically measured by using dedicated print register marks or targets which are usually printed in margins outside the effective printed area of the printed material. One example of this measurement principle is for instance the "LUCHS" register measurement system developed by Polygraphische innovative Technik Leipzig GmbH (PITSID—www.pitsidleipzig.com). Such special print register marks or targets have the disadvantage that they require additional space on the printed material, which space is also used for other purposes such as colour measurement. Furthermore, due to their location outside of the effective printed area, it is in effect not possible to measure the actual print-to-print register within the effective printed area of the printed material without compromising or interfering with the design to be printed.

There is therefore a need to improve the known solutions to measure print-to-print register of multicolour prints.

SUMMARY OF THE INVENTION

A general aim of the invention is to provide an improved solution of measuring print-to-print register of a multicolour print, which solution can furthermore be used to correct the print-to-print register in a more efficient manner.

More precisely, an aim of the present invention is to provide such a solution that does not require the use of special print register marks or targets.

These aims are achieved thanks to the solutions defined in the claims.

There is accordingly provided a process of measuring print-to-print register of a multicolour print provided in an effective printed area of the surface of printed material, which multicolour print is formed on the printed material by means of one or more printing presses and includes at least a first pattern and a second pattern distinguishable from the first pattern, the effective printed area being provided with a matrix arrangement of individual imprints which are each provided with the multicolour print and are repeated over the surface of the effective printed area along a pattern of rows and columns. According to the invention, measurement of an actual print-to-print register between the first and second patterns, as reflected on the printed material, is derived from processing and finding a correspondence between (i) at least one sample image of the printed material covering at least a portion of the first and second patterns and (ii) at least one corresponding reference image generated using prepress design data of the first and second patterns. Furthermore, the process is repeated for multiple ones of the individual imprints so as to derive a set of multiple measurements of the actual print-to-print register between the first and second patterns at various imprint locations over the effective printed area, which set of multiple measurements is mapped into a corresponding print-to-print register map that is representative of print-to-print register deviations at the various imprint locations.

According to a preferred embodiment of the invention, the process comprises the following steps:

a) producing at least one print sample of the printed material reflecting the actual print-to-print register between the first and second patterns;

b) selecting at least one region of interest on the print sample, which selected region of interest includes at least a portion of the first pattern and at least a portion of the second pattern;

c) acquiring an image of the print sample covering at least the selected region of interest on the print sample and processing the image of the print sample to generate at least one sample image corresponding to the selected region of interest;

d) generating at least one reference image of the first and second patterns in a region corresponding to the selected region of interest using prepress design data of the first and second patterns, which at least one reference image reflects a desired position of the first and second patterns;

e) for each one of the first and second patterns, finding a correspondence between the at least one sample image and the at least one reference image and extracting positional information from a result of the correspondence, which positional information is representative of an actual position of each one of the first and second patterns; and f) deriving a measurement of the actual print-to-print register between the first and second patterns in the print sample based on the positional information of the first and second patterns extracted at step e).

In this context, step d) preferably includes generating a separate reference image of each one of the first and second patterns, namely:

d1) generating a first reference image of the first pattern in the region corresponding to the selected region of interest using prepress design data of the first pattern; and d2) generating a second reference image of the second pattern in the region corresponding to the selected region of interest using prepress design data of the second pattern, and step e) preferably includes:

e1) finding a correspondence between the at least one sample image and the first reference image and extracting positional information from a result of the correspondence, which positional information is representative of the actual position of the first pattern; and e2) finding a correspondence between the at least one sample image and the second reference image and extracting positional information from a result of the correspondence, which positional information is representative of the actual position of the second pattern.

Even more preferably, step c) includes:

c1) processing the image of the print sample to generate a first sample image where the first pattern is enhanced; and c2) processing the image of the print sample to generate a second sample image where the second pattern is enhanced, the positional information of the first pattern being extracted at step e1) by finding a correspondence between the first sample image and the first reference image, and the positional information of the second pattern being extracted at step e2) by finding a correspondence between the second sample image and the second reference image.

In the context of the aforementioned preferred embodiment, processing of the image of the print sample may advantageously include correcting orientation and/or scale of the image in order to match an expected orientation and/or scale of the first and second patterns.

In accordance with a particularly advantageous embodiment of the invention, the correspondence between the at least one sample image and the at least one reference image is found by performing a cross-correlation between the at least one sample image and the at least one reference image, which cross-correlation includes finding an optimum of a correlation function between the at least one sample image and the at least one reference image.

Preferably, the measurement process could be repeated for each one of the individual imprints so as to derive at least one measurement of the actual print-to-print register between the first and second patterns at each imprint location.

The aforementioned invention is applicable to multicolour prints comprising more than two patterns, in which case the process can be carried out in order to measure print-to-print register between multiple pairs of patterns.

There is also provided a process of measuring and correcting print-to-print register of a multicolour print provided in an effective printed area of the surface of printed material, which multicolour print is formed on the printed material by means of one or more printing presses and includes at least a first pattern and a second pattern distinguishable from the first pattern, the effective printed area being provided with a matrix arrangement of individual imprints which are each provided with the multicolour print and are repeated over the surface of the effective printed area along a pattern of rows and columns, the process comprising the following steps:

(i) measuring print-to-print register of the multicolour print in accordance with the aforementioned measurement process to derive a set of multiple measurements of the actual print-to-print register between the first and second patterns at various imprint locations over the effective printed area, which set of multiple measurements is mapped into a corresponding print-to-print register map that is representative of print-to-print register deviations at the various imprint locations; and (ii) determining a plate correction of at least one printing plate used to print the multicolour print based on the print-to-print register map derived at step (i) in order to correct print-to-print register deviations between the first and second patterns.

Such plate correction can in particular be used to correct a position of the at least one printing plate in the relevant printing press or to correct plate origination data for the production of the at least one printing plate.

According to the invention, the plate correction is advantageously determined in dependence of the print-to-print register map, which leads to a more optimal correction of the print-to-print deviations as the print-to-print register map provides an extensive and more optimal representation of the relevant print-to-print register deviations at the various imprint locations.

Once again, in the event that the multicolour print is formed using more than two printing plates, the process can be carried out in order to correct print-to-print register between multiple pairs of printing plates.

Different approaches can be contemplated with a view to determine the relevant plate correction(s). One such approach is to minimize an average print-to-print register deviation. Another more preferable approach is to bring a maximum print-to-print register deviation within desired tolerances.

The aforementioned processes can advantageously be applied in the event that the multicolour print is formed on the printed material by means of a multicolour printing press comprising multiple printing plates, in particular a multicolour printing press for the production of security documents, such as a multicolour offset printing press for simultaneous recto-verso printing. The invention is however equally applicable in the event that the multicolour print is formed on the printed material by means of a multiple printing presses, irrespective of whether the printed material is printed in accordance with one and a same printing technique (such as offset printing only) or different printing techniques (such as combination of offset printing and intaglio printing for instance).

There is furthermore provided a measuring device to measure print-to-print register of a multicolour print provided in an effective printed area of the surface of printed material, which multicolour print is formed on the printed material by means of one or more printing presses and includes at least a first pattern and a second pattern distinguishable from the first pattern, the effective printed area being provided with a matrix arrangement of individual imprints which are each provided with the multicolour print and are repeated over the surface of the effective printed area along a pattern of rows and columns, wherein the measuring device comprises an image acquisition system and a processing system designed to perform the aforementioned measurement process.

Further advantageous embodiments of the invention are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which:

FIG. 9 shows a first sample image obtained from processing the image of FIG. 7 with a view to enhance the first pattern;

FIG. 10 shows a second sample image obtained from processing the image of FIG. 7 with a view to enhance the second pattern;

FIG. 14 is a black-and-white representation of the second pattern shown in FIG. 11;

FIG. 15 is a negative of the black-and-white representation of FIG. 14 which is used, by way of preference, as a second reference image for positioning of the second pattern;

DETAILED DESCRIPTION OF EMBODIMENTS OF THE INVENTION

The present invention will be described in the particular context of a sheet-fed offset printing press for simultaneous recto-verso printing of sheets as used for the production of security documents, such as banknotes. In this particular context, sheets are typically provided on both sides with a series of multicolour prints that are produced in one pass on the printing press.

The invention is however applicable for the purpose of measuring (and possibly correcting) print-to-print register of any multicolour print, irrespective of whether the multicolour print is produced in one pass on a single multicolour printing press or in several consecutive passes on multiple printing presses. Offset printing is furthermore one possible field of application of the invention. The invention is equally applicable in the context of printed material that is provided with a combination of printed patterns produced in accordance with the same or different printing processes, such as for instance a multicolour print resulting from a combination of an offset-printed pattern with an intaglio-printed pattern.

It goes without saying that the printed material onto which the multicolour print is formed can take any suitable shape or form, in particular the form of individual sheets or a continuous web.

Figure 3:
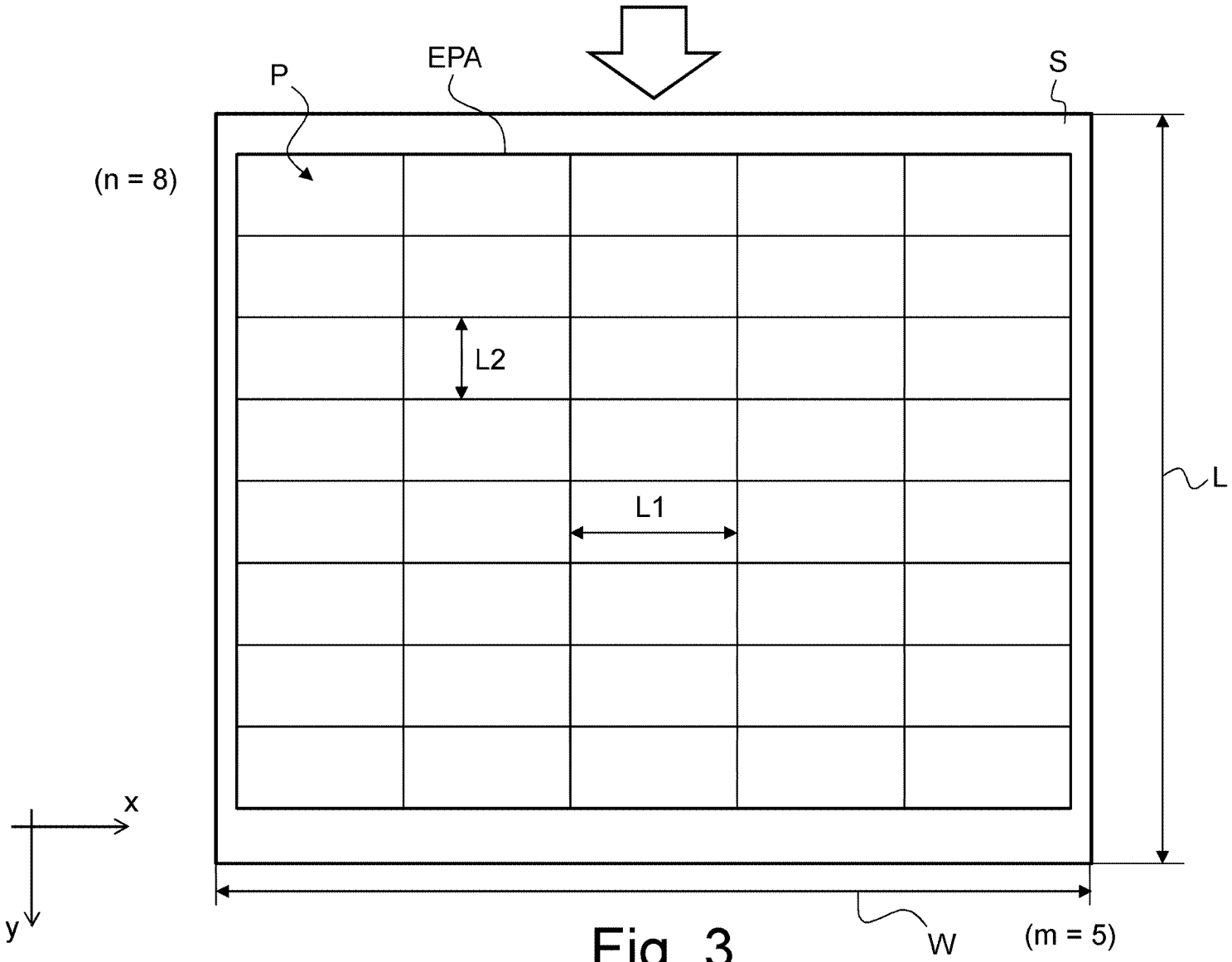
FIG. 3 is a schematic view of an illustrative printed sheet as used in the context of the production of security documents, such as banknotes.

In the particular context of the production of banknotes or like securities, the printed material is typically provided with a matrix arrangement of multiple security imprints printed on the sheets as for instance illustrated in FIG. 3, which FIG. 3 schematically illustrates printed material in the form of a sheet. As this will be appreciated from reading the following description, the present invention is particularly advantageous in this context as it allows to carry out a series of print-to-print register measurements in multiple ones or even each one of the imprint locations on the printed material.

Figure 1:
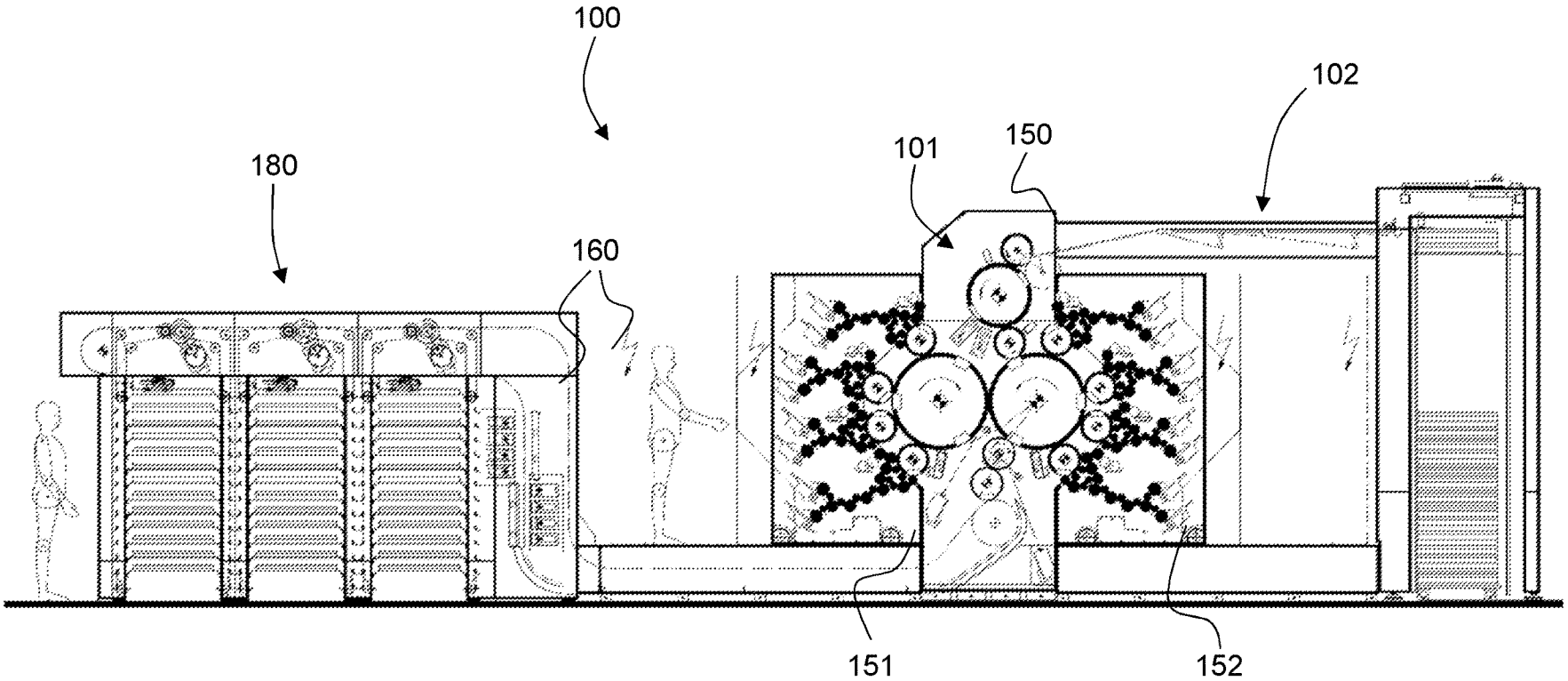
FIG. 1 is a schematic side view of a printing press designed for simultaneous recto-verso printing of sheets as typically used for the production of security documents, such as banknotes.
Figure 2:
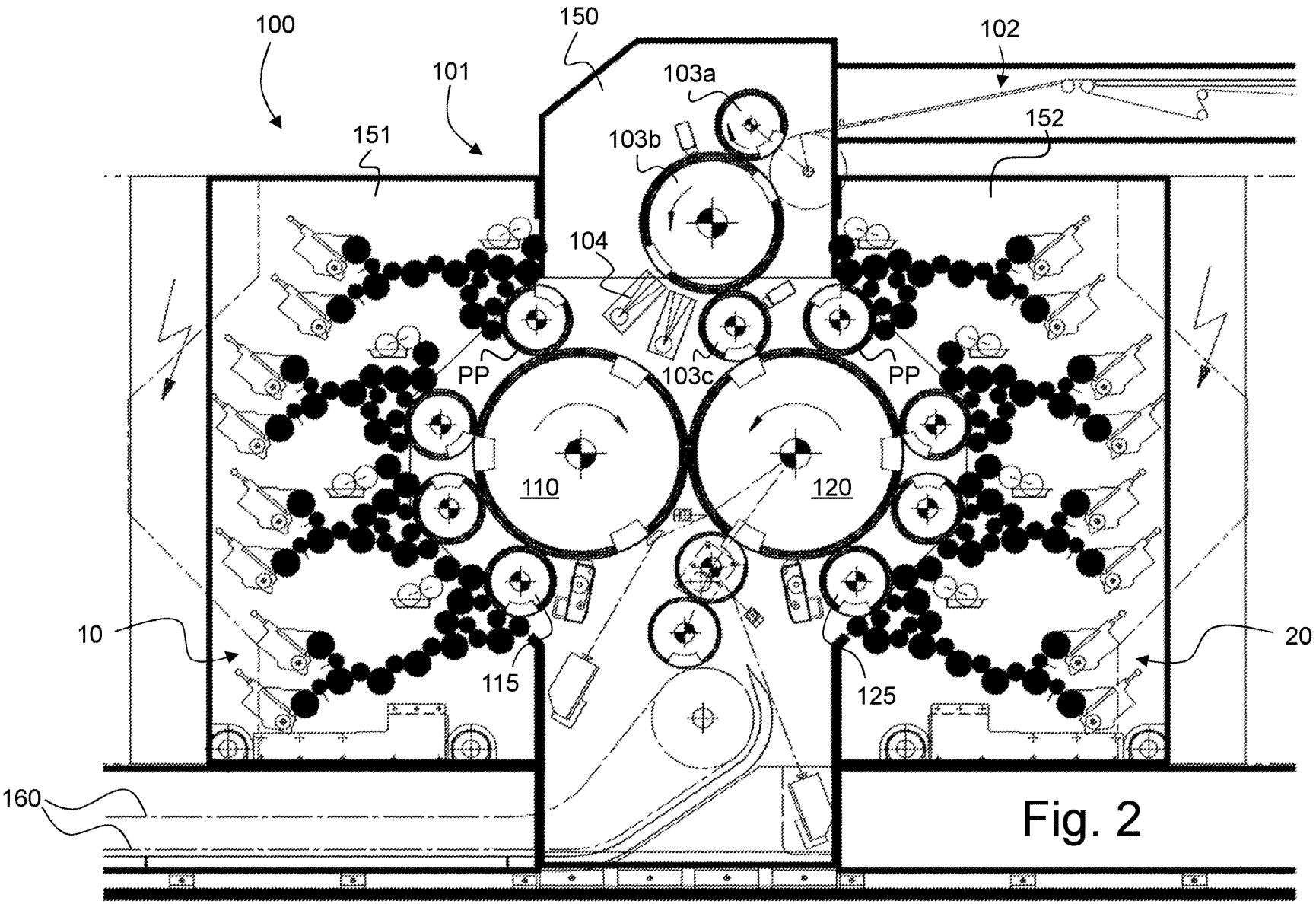
FIG. 2 is a schematic partial side view of the printing group of the printing press of FIG. 1.

FIGS. 1 and 2 illustrate a known sheet-fed offset printing press for simultaneous recto-verso printing of sheets of security documents as typically used for the production of banknotes, which printing press is designated globally by reference numeral 100. Such printing press is in particular marketed by the present Applicant under the product designation Super Simultan® IV. The basic configuration of this printing press is already described in International (PCT)

Publication No. WO 2007/105059 A1, which publication is incorporated herein by reference in its entirety.

This printing press 100 comprises an offset printing group 101, which is specifically adapted to perform simultaneous recto-verso offset printing of the sheets and comprises, as is typical in the art, two blanket cylinders (or impression cylinders) 110, 120 (referenced in FIG. 2) rotating in the direction indicated by the arrows and between which the sheets are fed to receive multicolour impressions simultaneously on both sides. In this example, blanket cylinders 110, 120 are three-segment cylinders which are supported between a pair of side frames designated by reference numeral 150. The blanket cylinders 110, 120 receive and collect different ink patterns in their respective colours from plate cylinders 115 and 125 (four on each side) which are distributed around a portion of the circumference of the blanket cylinders 110, 120. These plate cylinders 115 and 125, which each carry a corresponding printing plate PP, are themselves inked by corresponding inking apparatuses 10 and 20, respectively. The two groups of inking apparatuses 10, 20 are advantageously placed in two inking carriages 151, 152 that can be moved toward or away from the centrally-located plate cylinders 115, 125 and blanket cylinders 110, 120.

As is known in the art, each printing plate PP is wrapped around the corresponding plate cylinder 115, 125 and clamped at its leading end and trailing end by a suitable plate clamping system, which plate clamping system is located in a corresponding cylinder pit of the plate cylinder (see e.g. International (PCT) Publications Nos. WO 2013/001518 A1, WO 2013/001009 A1 and WO 2013/001010 A2).

Sheets are fed from a sheet feeding group 102 (including a feeder and feeder table) located next to the printing group 101 (on the right-hand side in FIGS. 1 and 2) to a succession of transfer cylinders 103*a*, 103*b*, 103*c* (three cylinders in this example) placed upstream of the blanket cylinders 110, 120. While being transported by the transfer cylinder 103*b*, the sheets may optionally receive a first impression on one side of the sheets using an additional printing group (not illustrated in FIGS. 1 and 2) as described for instance in U.S. Pat. No. 6,101,939 and International (PCT) Publication No. WO 2007/042919 A2, transfer cylinder 103*b* fulfilling the additional function of impression cylinder in such a case. In case the sheets are printed by means of the optional additional printing group, the sheets are first dried by a drying or curing unit 104 before being transferred to the blanket cylinders 110, 120 for simultaneous recto-verso printing.

In the example of FIGS. 1 and 2, the sheets are transferred onto the surface of blanket cylinder 120 where a leading edge of each sheet is held by appropriate gripper means located in cylinder pits between each segment of the blanket cylinder 120. Each sheet is thus transported by the blanket cylinder 120 to the printing nip between the blanket cylinders 110 and 120 where simultaneous recto-verso printing occurs. Once printed on both sides, the printed sheets are then transferred, as known in the art, to a chain gripper system 160 for delivery in a sheet delivery station 180 comprising multiple delivery pile units (three delivery pile units being depicted in this example).

In the example of FIGS. 1 and 2, first and second transfer cylinders (not referenced), such as suction drums or cylinders, are interposed between the chain gripper system 160 and the blanket cylinder 120. These first and second transfer cylinders are optional and designed to carry out inspection of the sheets on the recto and verso sides as described in International application No. WO 2007/105059 A1.

It will be appreciated that print-to-print register on the recto and verso sides of the sheets is dependent on various factors. Prepress plate production, plate mounting, printing process, and substrate material behaviour in particular contribute to the distortion and print-to-print register of the printed patterns. In the context of the sheet-fed offset printing press of FIGS. 1 and 2, mounting of each printing plate PP on the four plate cylinders 115 used to print the recto side of the sheets and on the four plate cylinders 125 used to print the verso side of the sheets is one key contributing factor to the print-to-print register of the resulting multicolour prints on both sides of the sheets. In particular, all four printing plates PP mounted on the plate cylinders 115 have to be adjusted so as to ensure the best possible print-to-print register on the recto side of the sheets. Likewise, all four printing plates PP mounted on the plate cylinders 120 have to be adjusted so as to ensure the best possible print-to-print register on the verso side of the sheets. Evidently, adequate print-to-print register between the recto and verso sides of the sheets (or recto-verso register) also requires a proper adjustment of the printing plates PP between the recto and verso sides. In that respect, it shall be appreciated that the invention is applicable in order to measure, and possibly correct, the print-to-print register of a multicolour print that could be formed on only one or both sides of the printed substrate material.

As far as the sheet-fed offset printing press of FIGS. 1 and 2 is concerned, and assuming that due account has been taken of the characteristics of the plate-making processes that are adopted to produce the relevant printing plates PP, print-to-print register on each side of the sheets will depend in particular on the way the relevant printing plates PP are mounted on the relevant plate cylinders 115, 125, the patterns forming the relevant multicolour prints on both sides of the sheets being first collected from the plate cylinders 115, 125 by the corresponding blanket cylinders 110, 120 before being transferred simultaneously onto the recto and verso sides of the sheets at the printing nip between the blanket cylinders 110, 120.

In the context of the production of security documents, such as banknotes, individual sheets (or successive portions of a continuous web) are typically printed in such a way as to exhibit a matrix arrangement of repetitive imprints arranged in multiple columns and rows (m×n). FIG. 3 schematically illustrates a printed sheet S as used in the context of the production of banknotes and like security documents. The printed sheet S has a width W, in a direction x (also referred to as the "axial direction") transversely to the path of the sheets S through the printing press as identified by the arrow in FIG. 3. A typical width W of the sheet S is 820 mm. The printed sheet S has a length L, in a direction y (also referred to as the "circumferential direction" y) parallel to the path of the sheets S through the printing press. A typical length L of the sheet S is 700 mm.

The printed sheet S is usually printed so as to exhibit, within an effective printed area EPA, a matrix arrangement of multiple imprints P arranged side by side in multiple rows and columns. In the illustrated example, forty imprints P are printed in the effective printed area EPA in a matrix arrangement of eight (n=8) rows and five (m=5) columns, each imprint P exhibiting certain dimensions L1 (in the axial direction x) and L2 (in the circumferential direction y).

In this context, it is desired to ensure optimum print-to-print register for all imprints P, i.e. all over the effective printed area EPA of the sheets S. A print-to-print register exceeding given tolerances will lead to the relevant imprint P being rejected as not meeting desired print quality requirements.

Figure 4:
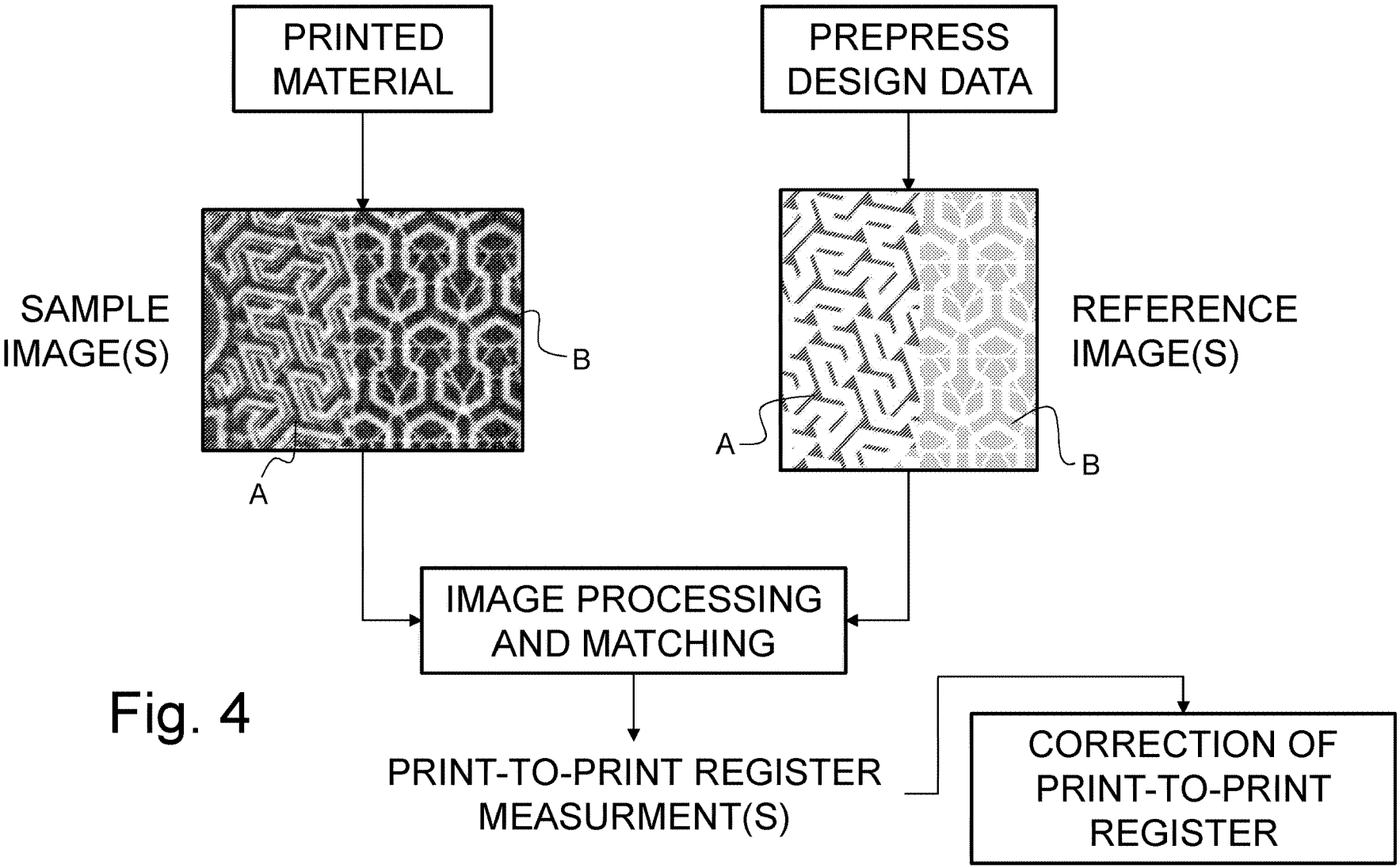
FIG. 4 is a schematic diagram illustrating the basic principle of the invention.

In accordance with the present invention, multiple print-to-print register measurements can be carried out at any desired imprint locations within the effective printed area EPA of the sheets S since each imprint location is provided with a multicolour print including at least a first pattern and a second pattern distinguishable from the first pattern. More precisely, as schematically illustrated in FIG. 4, measurement of an actual print-to-print register between first and second patterns A, B of the multicolour print, as reflected on the printed material, is derived, according to the present invention, from processing and finding a correspondence between (i) at least one sample image of the printed material covering at least a portion of the first and second patterns A, B, and (ii) at least one corresponding reference image generated using prepress design data of the first and second patterns A, B. As this will be appreciated from reading the following description of a preferred embodiment of the invention, image processing and matching techniques are used to process the aforementioned images and derive a measurement of the actual print-to-print register between the relevant pair of patterns, be it patterns A, B or any other pair of patterns forming part of the multicolour print. Once the actual print-to-print register has been measured, it is possible to additionally perform a correction of this print-to-print register, in particular by computing an adequate plate correction, preferably a correction of the position of one or more of the printing plates used to print the relevant patterns, so as to minimize any misregister. This correction process can in effect be separated from the measurement process as such.

A particularly preferred and advantageous embodiment of the invention will be described with reference to FIGS. 5 to 23. In accordance with this preferred embodiment, at least one print sample of the printed material is required, which print sample reflects an actual print-to-print register of the multicolour print (which will be assumed to be imperfect for the sake of the explanation). This basically implies producing one or more print samples of the relevant printed material, such as one or more printed sheets produced by means of the printing press of FIGS. 1 and 2.

Figure 5:
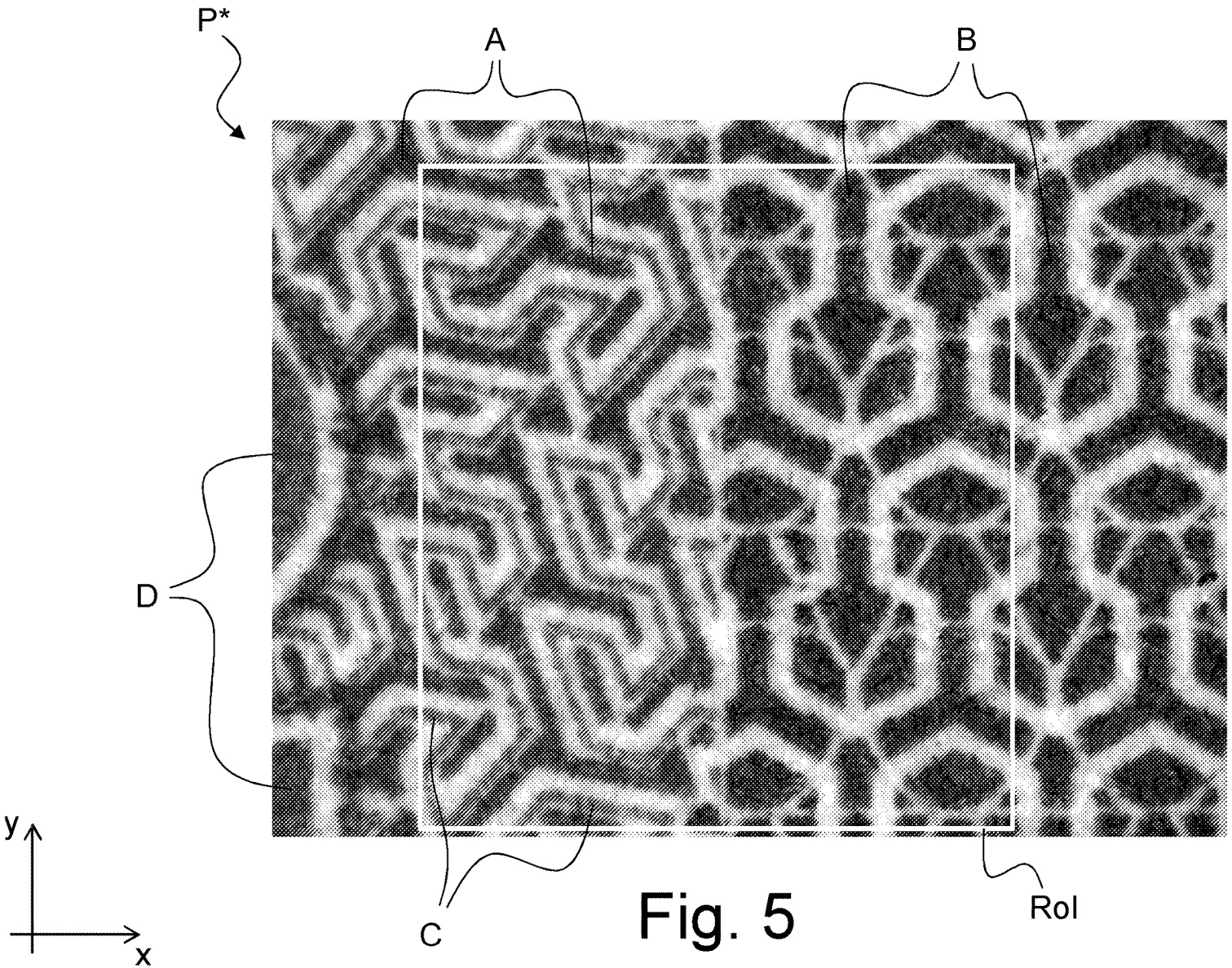
FIG. 5 shows an image of a portion of a print sample of printed material (namely an image of a portion of a printed banknote specimen) as printed on a printing press of the type shown in FIGS. 1 and 2, which printed material is provided with a multicolour print that includes multiple juxtaposed printed patterns and reflects an actual print-to-print register between the printed patterns.

Once the relevant print sample is available, one should identify and select at least one region of interest on the print sample where at least a portion of the first pattern and at least a portion of the second pattern are present. This region of interest should preferably target those portions of the multicolour print which are very sensitive to a misregister, i.e. patterns which are particularly revelatory of a slight deviation in the print-to-print register. Such register-sensitive elements may in particular be multicolour printed patterns consisting of or jointly forming fine structures, such as multicolour positive or negative guilloche patterns exhibiting fine curvilinear structures for instance. FIG. 5 shows an image of a portion P* of a print sample of the printed material (namely an image of a portion of a printed banknote specimen used here as illustrative example) as printed on a printing press of the type shown in FIGS. 1 and 2, which image is acquired by any suitable means, such as a colour camera. This printed material is provided with a multicolour print that includes multiple juxtaposed (and/or possibly overlapping) printed patterns, four of which are visible on the portion P* depicted in FIG. 5 and are designated by references A, B, C, D. An appropriate region of interest RoI is highlighted by a white border in FIG. 5. In the illustration of FIG. 5, a portion of patterns A, B and C is visible within the relevant region of interest RoI, pattern D being outside of this region of interest RoI. For the purpose of the explanation, one shall in particular focus on patterns A and B, with a view to explain how print-to-print register is measured between pattern A (the "first pattern" for the purpose of the explanation) and pattern B (the "second pattern" for the purpose of the explanation). It will be understood that the relevant principle is equally applicable to measure print-to-print register between patterns A and C or between patterns B and C, or any other pair of patterns visible in the relevant region of interest.

It is worthwhile to point out at this stage that the relevant region(s) of interest could be preselected based on the prepress design data of the patterns forming the multicolour print. Indeed, it is possible to identify in the prepress design data alone which areas of the multicolour print are more suited to measuring print-to-print register, i.e. which areas contain register-sensitive elements.

Figure 6:
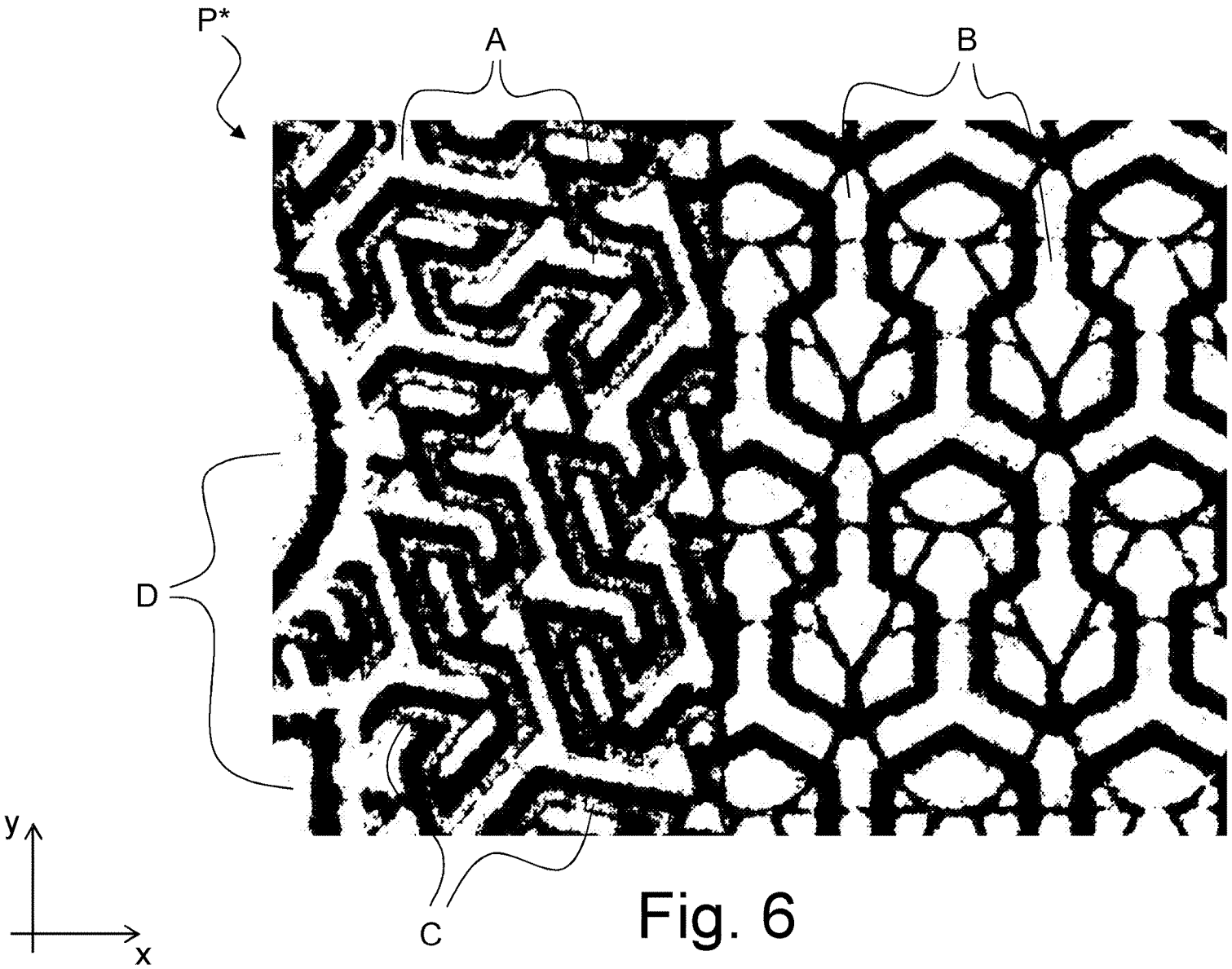
FIG. 6 is an illustrative black-and-white negative deriving from the image of FIG. 5.

FIG. 6 is an illustrative black-and-white negative deriving from the image of FIG. 5, i.e. a negative of the image of FIG. 5 which has been binarized, i.e. converted to black-and-white representation using a given binarization threshold selected between the lighter and darker regions of the image of FIG. 5. In the representation of FIG. 6, the relevant patterns A, B, C, D therefore appear as mostly white regions and the unprinted areas of the printed material as mostly black regions.

Figure 7:
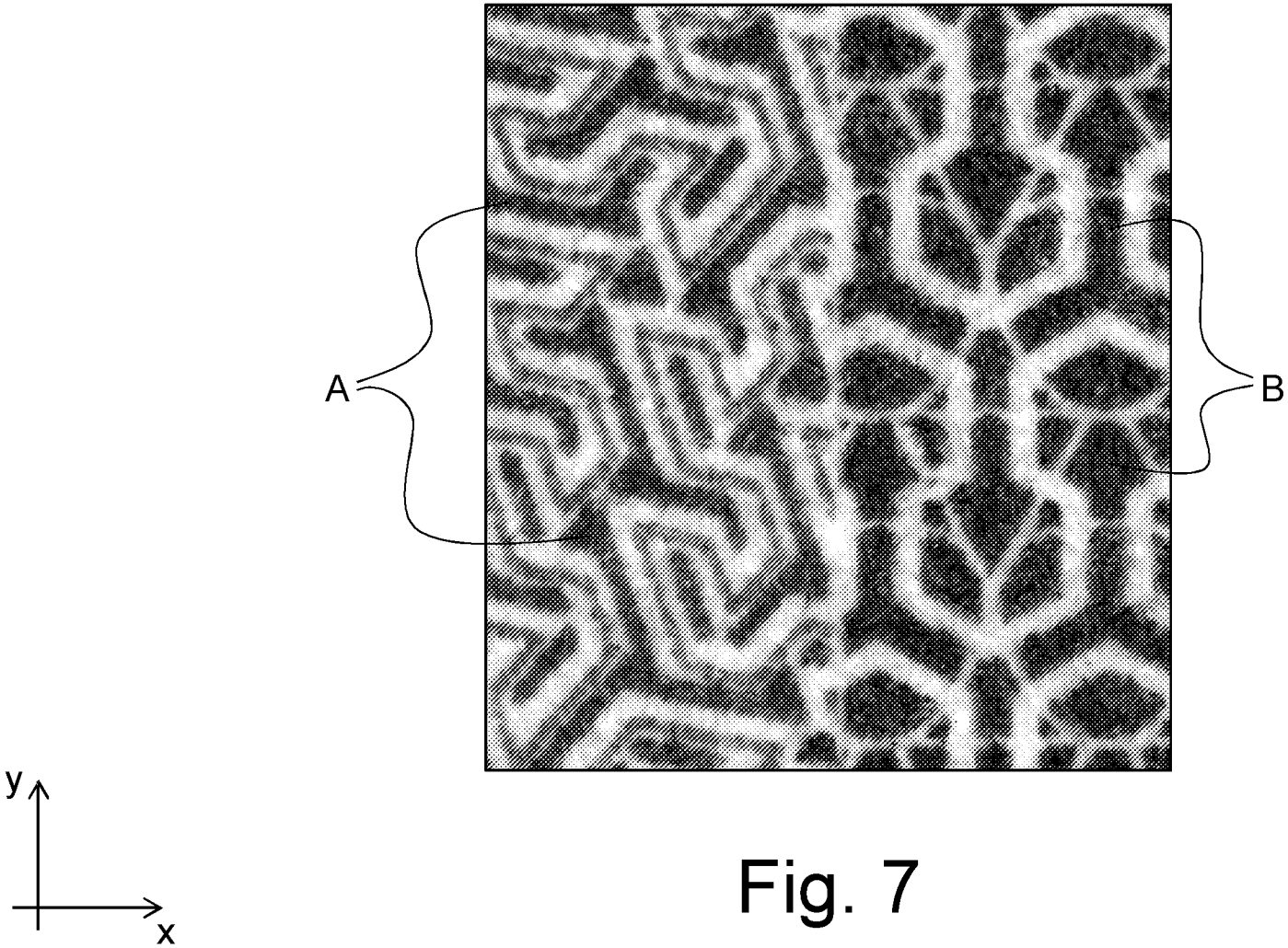
FIG. 7 is a portion of the image of FIG. 5 corresponding to a selected region of interest including at least a portion of a first pattern and at least a portion of a second pattern forming part of the multicolour print, which selected region of interest is highlighted in FIG. 5.
Figure 8:
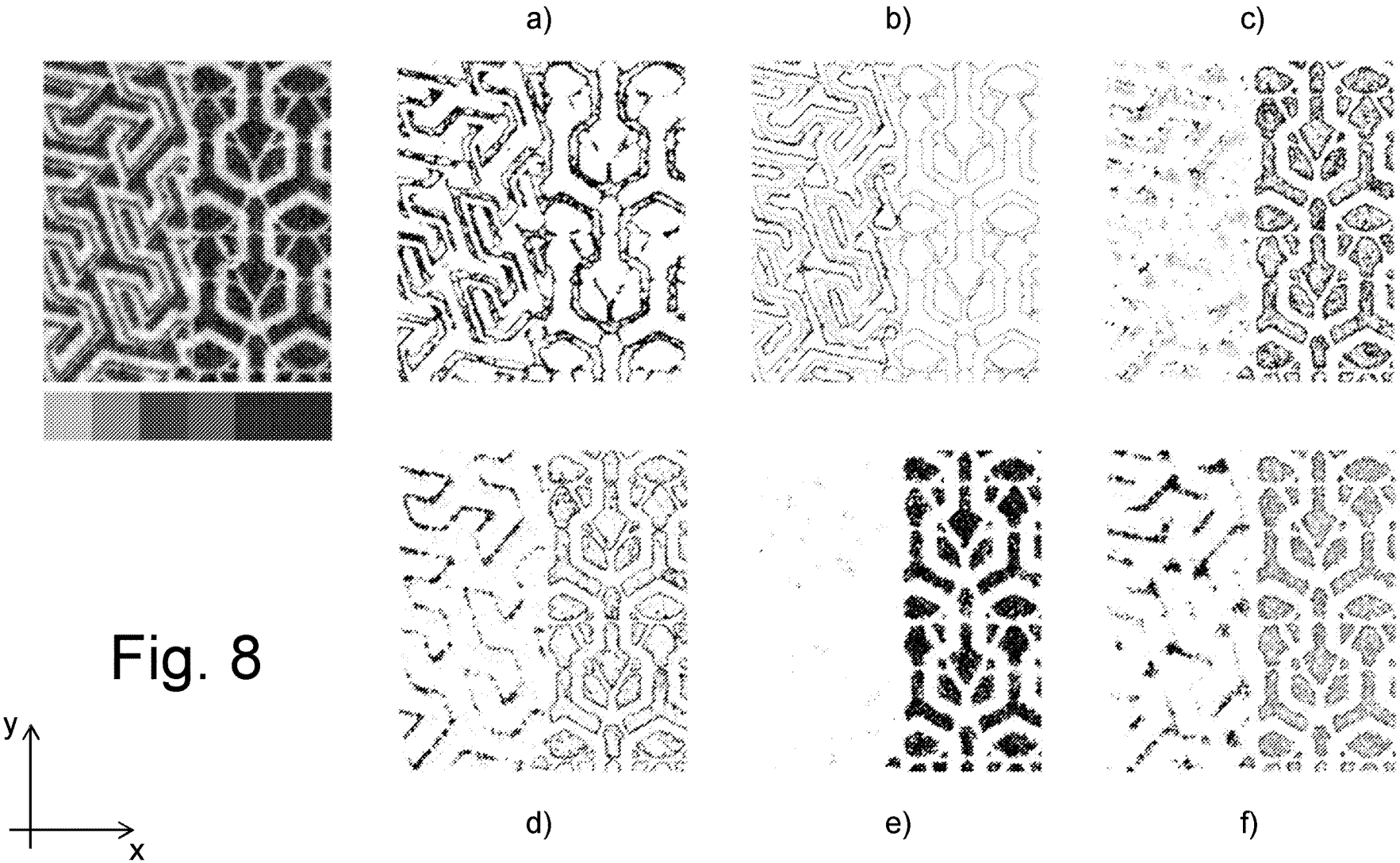
FIG. 8 is illustrative of a decomposition of the image of FIG. 7 in dependence of multiple colour components of the image.

Once the relevant region of interest RoI has been selected as illustrated e.g. by FIG. 5, the image of the print sample is processed to generate at least one sample image corresponding to the selected region of interest RoI. FIG. 7 shows an image of the print sample taken inside the region of interest RoI of FIG. 5 and where patterns A and B are once again visible. In accordance with this preferred embodiment of the invention, it is advantageous to process the image of the print sample in order to produce first and second sample images where the first and second patterns A, B are enhanced (i.e. more clearly identifiable). Various image processing or filtering techniques could be used for that purpose. FIG. 8 for instance illustrates a possible processing of the image of the print sample in dependence of six selected colour components of the image, leading to multiple processed representations a) to f) of the relevant image.

By way of illustration, FIG. 9 shows a first sample image $SI_A$ obtained from processing the image of FIG. 7 with a view to enhance the first pattern A, while FIG. 10 shows a second sample image $SI_B$ obtained from processing the sample image of FIG. 7 with a view to enhance the second pattern B. In the context of the preferred embodiment of the invention, these first and second sample images $SI_A$ and $SI_B$ are used for the purpose of measuring print-to-print register between patterns A and B. Such processing can be carried out in accordance with any adequate image processing technique allowing, for instance, isolation or like enhancement of any given colour of the printed patterns in the original image. By way of illustration, representation e) in FIG. 8 is very representative of the second pattern B in isolation and can be used to generate the corresponding sample image $SI_B$ shown in FIG. 10. In practice, the relevant image processing techniques will be adapted and tailored to the relevant colours of the patterns present in the image, which colours are a known and expected variable.

In order to measure print-to-print register between patterns A and B, one further needs a suitable reference image (or reference images) of the first and second patterns A, B in a region corresponding to the selected region of interest RoI. In accordance with the invention, such reference image(s) of the first and second patterns A, B is(are) generated using prepress design data of the first and second patterns A, B, with the reference image(s) being defined so as to reflect a desired (i.e. known or expected) position of the first and second patterns A, B. The relevant reference images can be binary ("black-and-white") images derived directly from the prepress design data—as in the example described hereinafter (see e.g. FIGS. 13 and 15)—or any other suitable image, such as processed or simulated images that more closely reflect an expected print result. In this latter case, the reference images could for instance be simulated images generated in accordance with the principles described in International (PCT) Publication No. WO 2013/132448 A1 in the name of the present Applicant, which publication is incorporated herein in its entirety. Tests carried out by the Applicant have however demonstrated that binary images are already adequate as reference images for the purpose of finding a correspondence with the relevant sample images. The principles described in International (PCT) Publication No. WO 2013/132448 A1 are also of advantage in that they in particular allow to simulate the sensitiveness of multicolour prints to register deviations.

Figure 11:
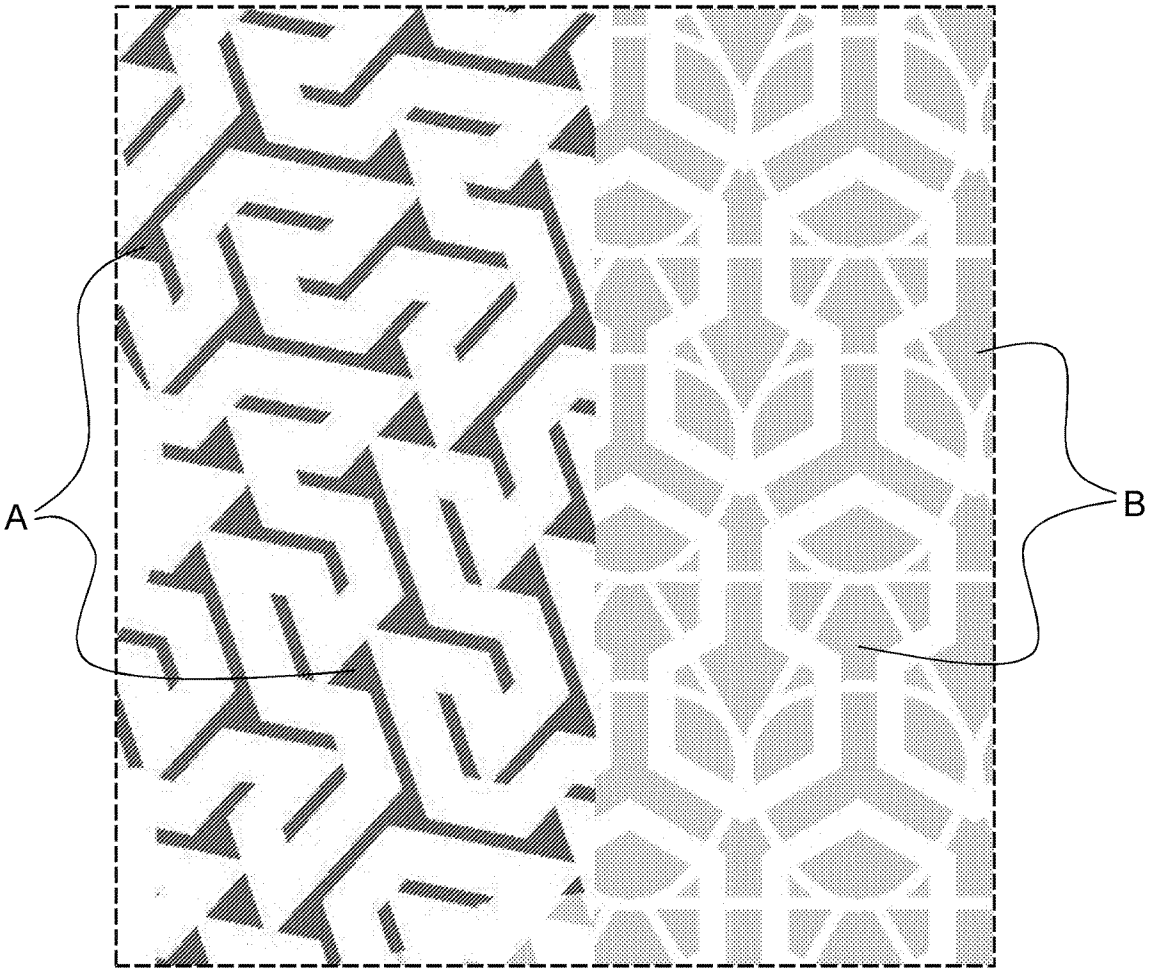
FIG. 11 is illustrative of prepress design data showing the first and second patterns of the multicolour print in a region corresponding to the selected region of interest and reflecting a desired position of the first and second patterns.
Figure 11:
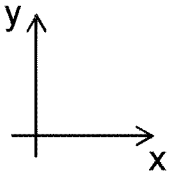

FIG. 11 is illustrative of prepress design data showing the first and second patterns A, B of the multicolour print P in a region corresponding to the selected region of interest RoI and reflecting a desired position of the first and second patterns. In the present example, it will be appreciated that the depicted region is larger than the selected region of interest RoI shown e.g. in FIG. 5. Only the first and second patterns A, B are shown in FIG. 11. Pattern C, which is also present in this area, is not taken into account as one is interested in measuring print-to-print register between patterns A and B in this illustrative example.

In accordance with the preferred embodiment of the invention, it is again advantageous to generate a separate reference image of each one of the first and second patterns A, B, namely a first reference image of the first pattern A and a second reference image of the second pattern B. Generation of such separate reference images is relatively straightforward as each pattern is typically defined by its associated prepress design data.

Figure 12:
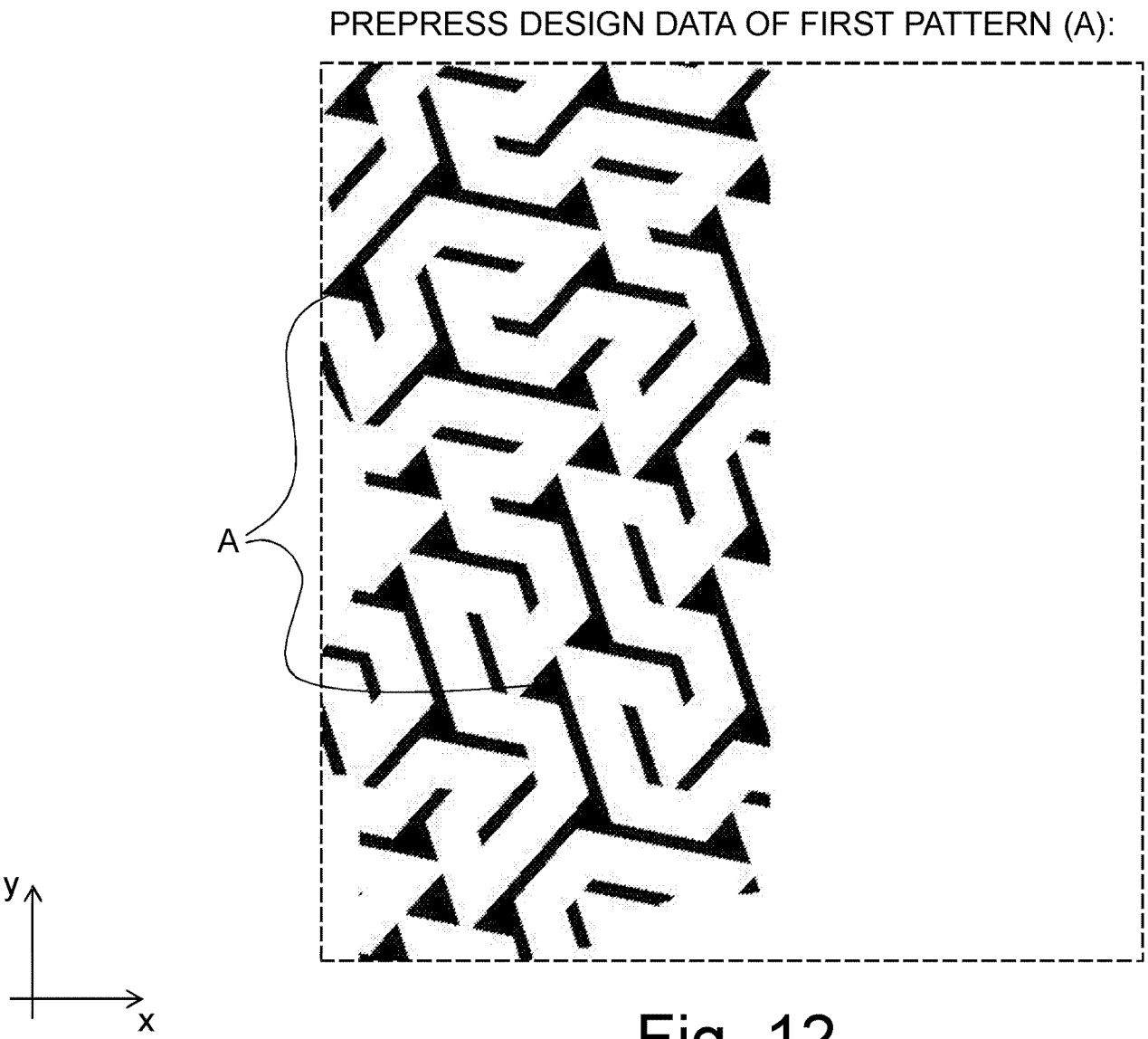
FIG. 12 is a black-and-white representation of the first pattern shown in FIG. 11.
Figure 13:
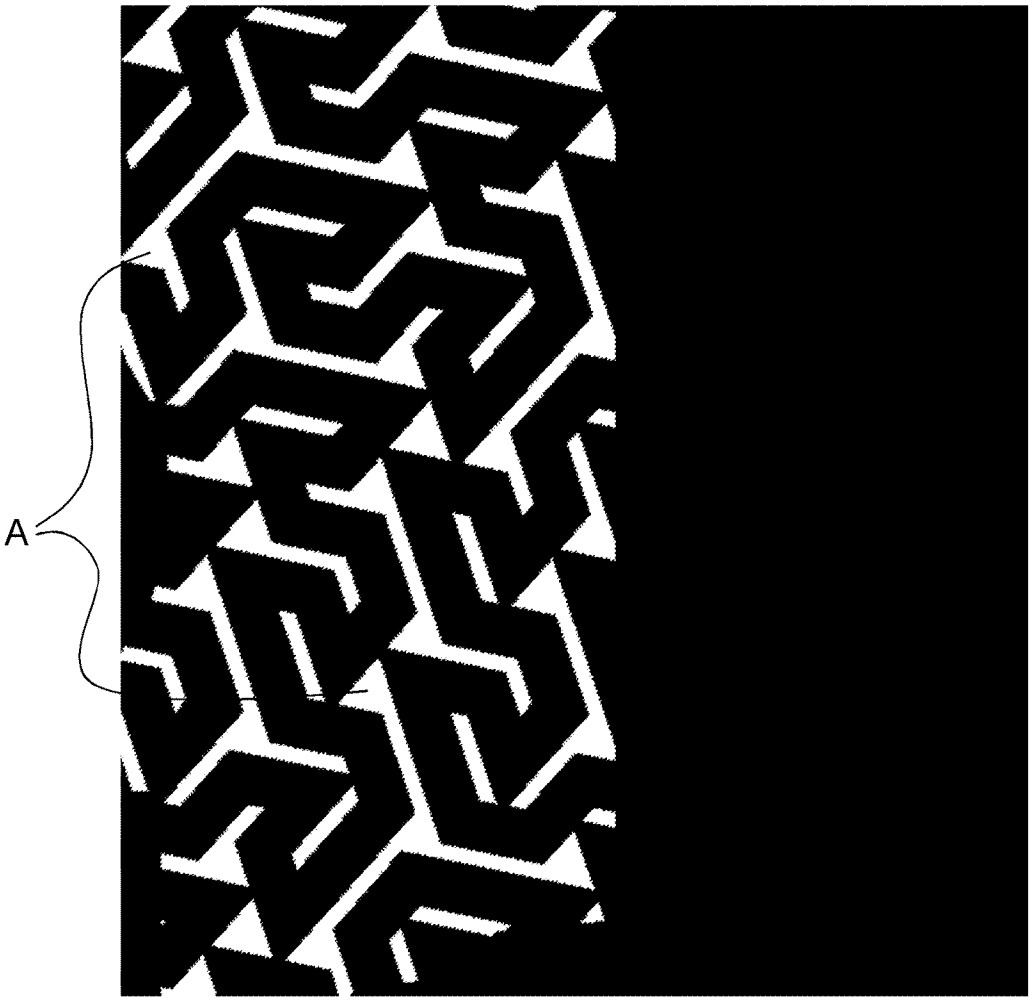
FIG. 13 is a negative of the black-and-white representation of FIG. 12 which is used, by way of preference, as a first reference image for positioning of the first pattern.
Figure 13:
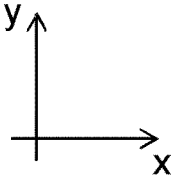

FIG. 12 is a black-and-white representation of the first pattern A shown in FIG. 11, while FIG. 13 is a negative of the black-and-white representation of FIG. 12. In other words, in FIG. 13, pattern A is identifiable as a white area on a black background. FIG. 13 is used here as first reference image $RI_A$ of the first pattern A.

FIG. 14 is likewise a black-and-white representation of the second pattern B shown in FIG. 11, while FIG. 15 is a negative of the black-and-white representation of FIG. 14. In other words, in FIG. 15, pattern B is once again identifiable as a white area on a black background. FIG. 15 is used here as second reference image $RI_B$ of the second pattern B.

A correspondence between the sample image(s) and the reference image(s) is looked for and found, for each one of the first and second patterns A, B with a view to extract positional information from the result of the correspondence. This positional information is representative of the actual position of each one of the first and second patterns A, B. In other words, on the basis of the positional information of each pattern A, B, it is possible to derive a measurement of the actual print-to-print register between the first and second patterns A, B in the print sample.

Figure 16:
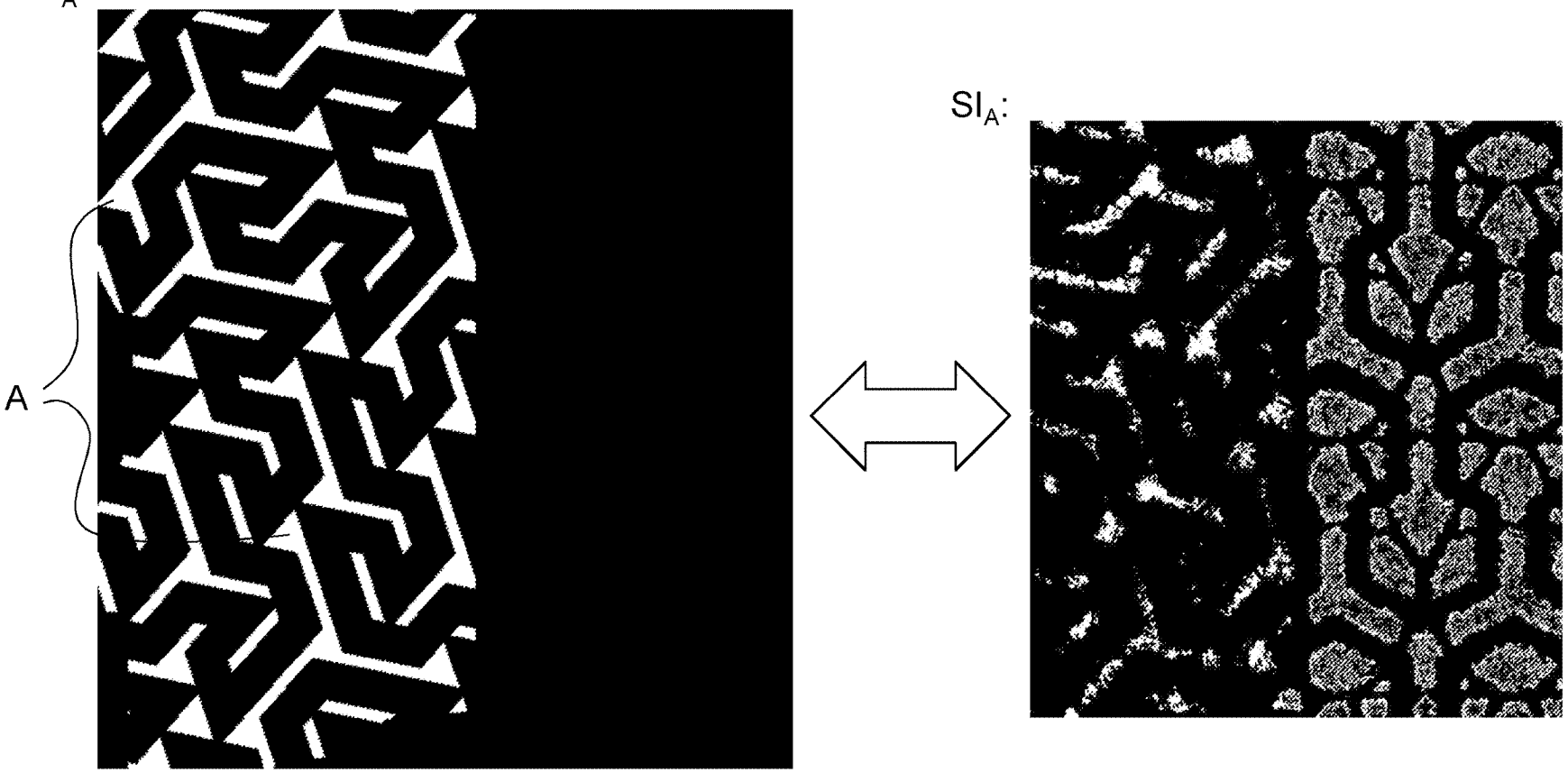
FIG. 16 schematically illustrates the step of finding a correspondence between the first reference image of FIG. 13 and the first sample image of FIG. 9.
Figure 17:
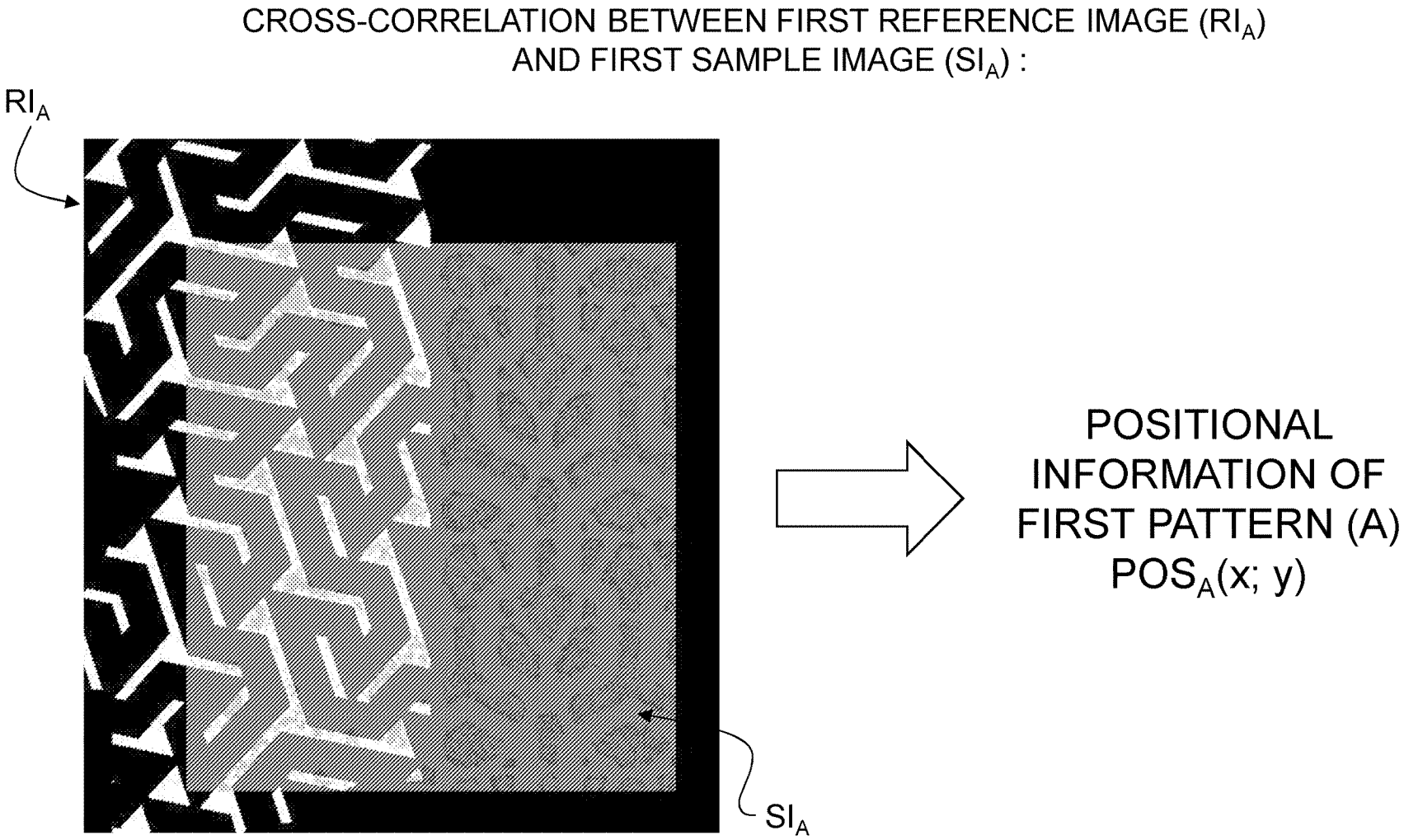
FIG. 17 schematically shows a superposition of the first reference image of FIG. 13 and the first sample image of FIG. 9.

FIG. 16 schematically illustrates the step of finding a correspondence between the first reference image $RI_A$ of FIG. 13 and the first sample image $SI_A$ of FIG. 9. A preferred way to find this correspondence is to perform a cross-correlation between the first reference image $RI_A$ and the first sample image $SI_A$ as schematically illustrated by FIG. 17, which shows a superposition of the first reference image $RI_A$ of FIG. 13 and of the first sample image $SI_A$ of FIG. 9 where both images closely match one with the other. In the present instance, the cross-correlation basically amounts to evaluating the correspondence in position of the two images as a function of relative offset between the two images, here as a function of two variables, namely x any y positions. It shall be appreciated that FIG. 17 schematically shows, by way of illustration, one step of a cross-correlation whereby the sample image $SI_A$ is positioned with respect to the reference image $RI_A$ (the opposite being also possible). The resulting cross-correlation function can be represented as a surface in this particular example (shown in FIG. 18), highlighting a peak corresponding to the best match between the two images. The relevant positional information $POS_A$ (x; y) of the first pattern A (with respect to a given reference point) can therefore be extracted. A sharp peak is indicative of a small error on the optimal relative position between the two images at position $POS_A$(x; y). In that respect, patterns that are very sensitive to print-to-print register deviations (i.e. "register-sensitive elements") will typically exhibit a sharp correlation peak and are to be preferred when it comes to selecting the relevant region of interest and the patterns contained therein.

Figure 19:
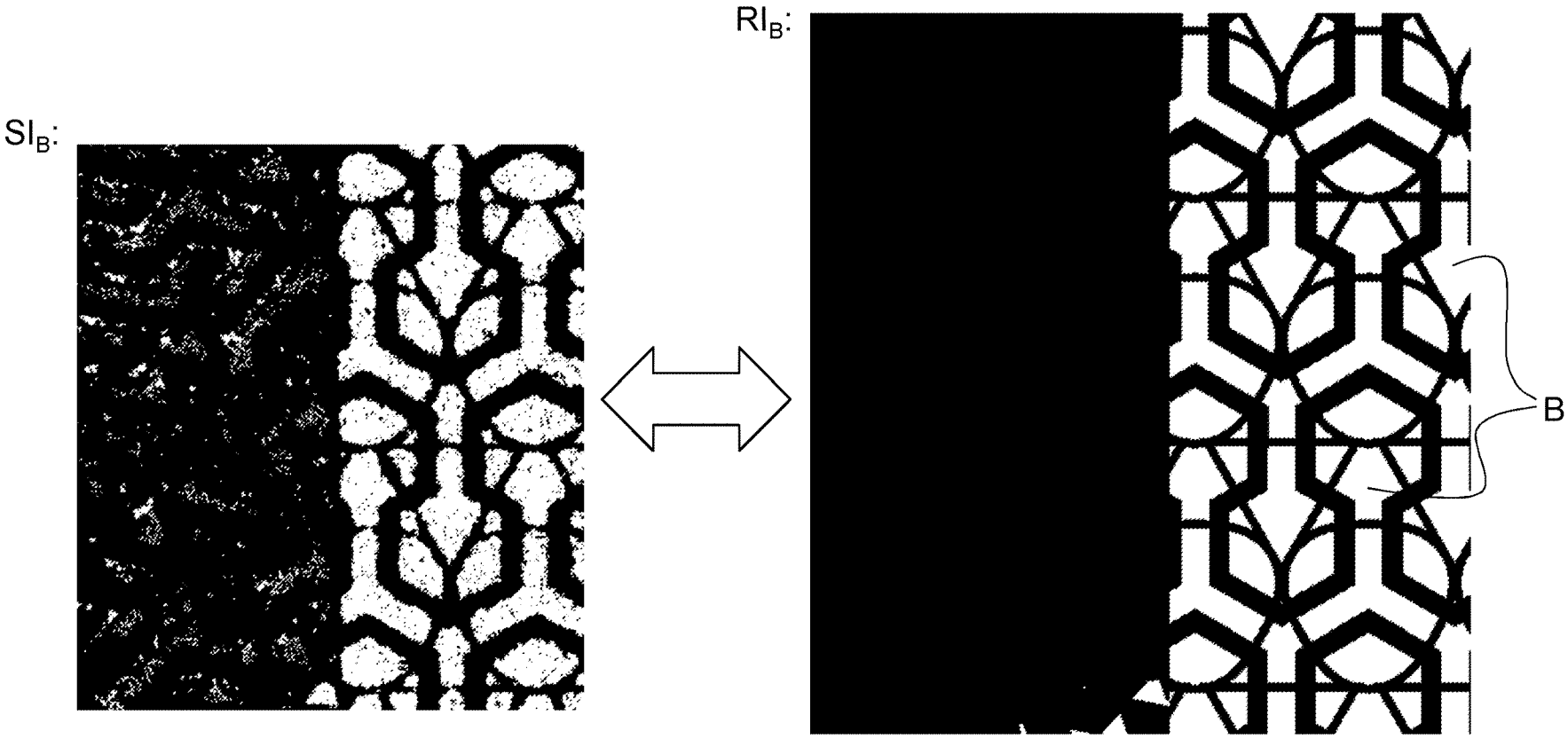
FIG. 19 schematically illustrates the step of finding a correspondence between the second reference image of FIG. 15 and the second sample image of FIG. 10.
Figure 20:
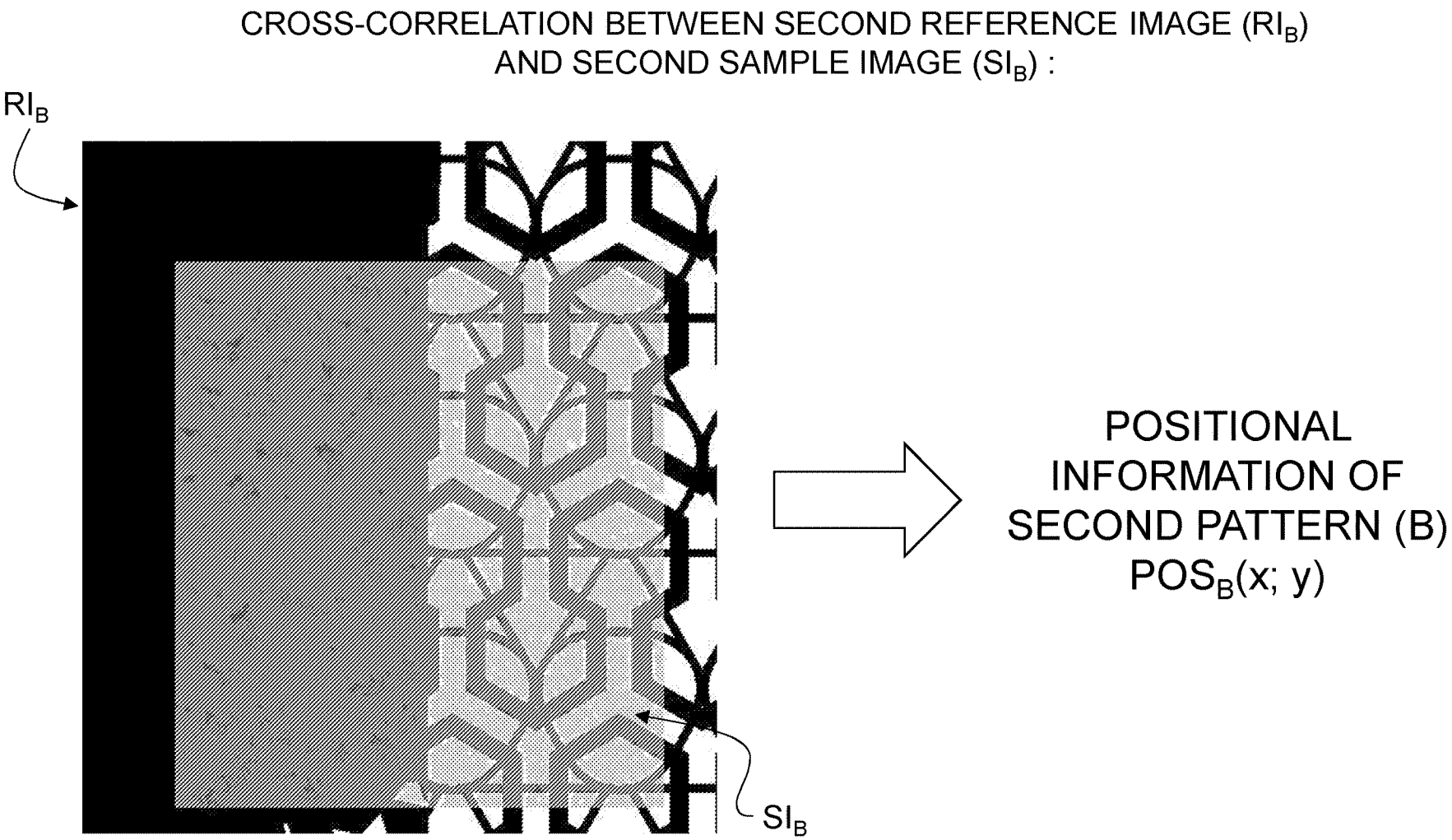
FIG. 20 schematically shows a superposition of the second reference image of FIG. 15 and the second sample image of FIG. 10.
Figure 21:
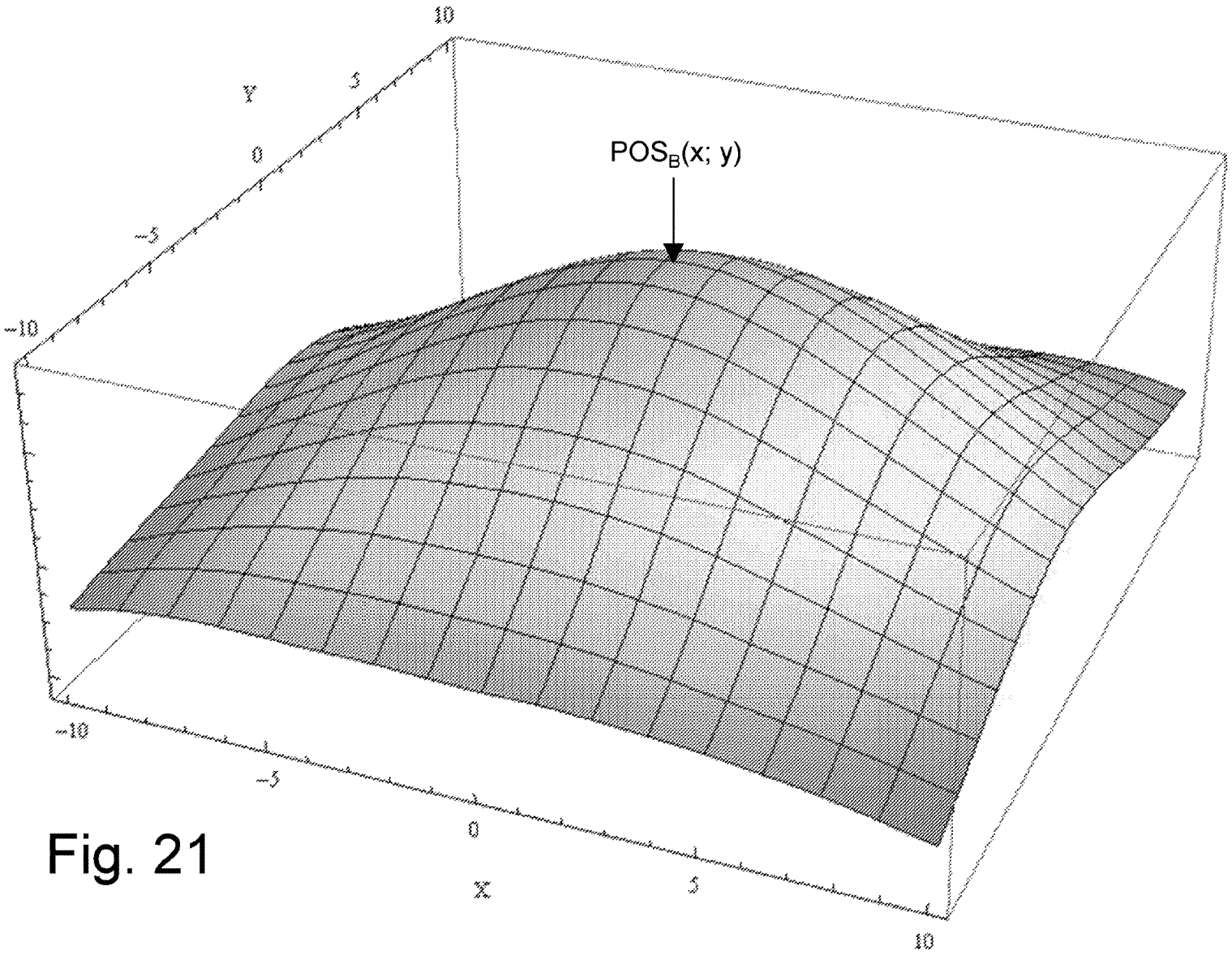
FIG. 21 illustrates the cross-correlation function between the two images of FIG. 20 and highlighting a peak corresponding to a best match between the two images, the position of the peak being used to extract the relevant positional information of the second pattern.

The same process is carried out in respect of the second pattern B. In that respect, FIG. 19 schematically illustrates the step of finding a correspondence between the second reference image $RI_B$ of FIG. 15 and the second sample image $SI_B$ of FIG. 10 and FIG. 20 illustrates a superposition of the second reference image $RI_B$ of FIG. 15 and of the second sample image $SI_B$ of FIG. 10 where both images closely match one with the other. It shall again be appreciated that FIG. 20 schematically shows, by way of illustration, one step of the cross-correlation whereby the sample image $SI_B$ is positioned with respect to the reference image $RI_B$ (the opposite being likewise also possible). The resulting cross-correlation function can once again be represented as a surface in the present instance (as shown in FIG. 21), highlighting a peak corresponding to the best match between the two images. The relevant positional information $POS_B$ (x; y) of the second pattern B (with respect to the given reference point) can likewise be extracted.

Figure 18:
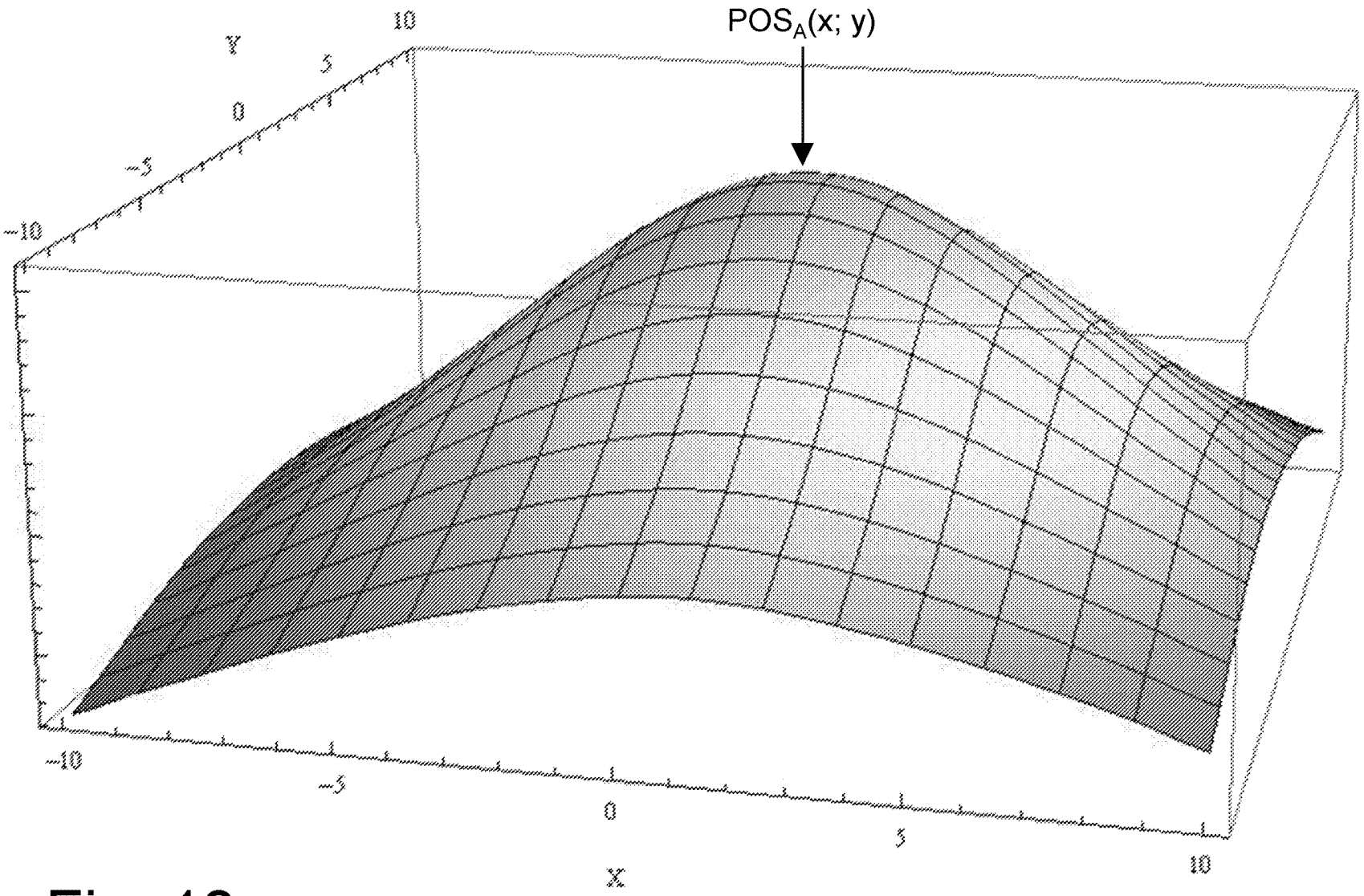
FIG. 18 illustrates the cross-correlation function between the two images of FIG. 17 and highlighting a peak corresponding to a best match between the two images, the position of the peak being used to extract the relevant positional information of the first pattern.

In the aforementioned context, it is advantageous to select the region of interest in such a way as to encompass patterns that lead to a cross-correlation function exhibiting a single, mostly symmetric peak within the measurement range (as for instance illustrated in FIGS. 18 and 21). Once again, a preselection of the relevant region(s) of interest can advantageously be performed beforehand based on the prepress design data directly as one can anticipate how the relevant cross-correlation function will look like.

Once the positional information $POS_A$(x; y), $POS_B$(x; y) of the patterns A, B is known, it is possible to compute the difference in relative position between both patterns A, B, i.e. derive a measurement of the actual print-to-print register between the first and second patterns A, B as reflected on the selected print sample.

By way of alternative, a single sample image and/or a single reference image could be used for the purpose of finding the relevant positional information of the first and second patterns A, B. FIG. 6 could for instance be used as single sample image for the purpose of a cross-correlation with the reference images $RI_A$ and $RI_B$ of FIGS. 13 and 15. It is however preferable to use distinct images for the purpose of separately locating the two patterns, as explained above, as this largely reduces interferences in the processing and increases the quality and reliability of the results.

It might be necessary to process the image of the print sample to correct orientation and/or scale of the sample image in order to closely match an expected orientation and/or scale of the first and second patterns. This allows in particular compensation of possible mismatches in the orientation and/or scale of the sample image(s), compared to the reference image(s), which mismatches may be due to the image acquisition process and related to the image acquisition system used to acquire the necessary image(s) of the print sample.

As already mentioned, a great advantage of the invention resides in that multiple measurements of the actual print-to-print register between two patterns of the multicolour print are performed at various locations on the print sample, preferably at all imprint locations on the sheet of FIG. 3. It is likewise possible to perform several measurements of the print-to-print register within one and a same imprint location, especially at various locations where register-sensitive elements are present. In other words, the aforementioned print-to-print register measurement process is repeated for multiple ones of the individual imprints P shown in FIG. 3 so as to derive a corresponding set of multiple measurements of the actual print-to-print register between the first and second patterns A, B at the various imprint locations over the effective printed area EPA.

Figure 22:
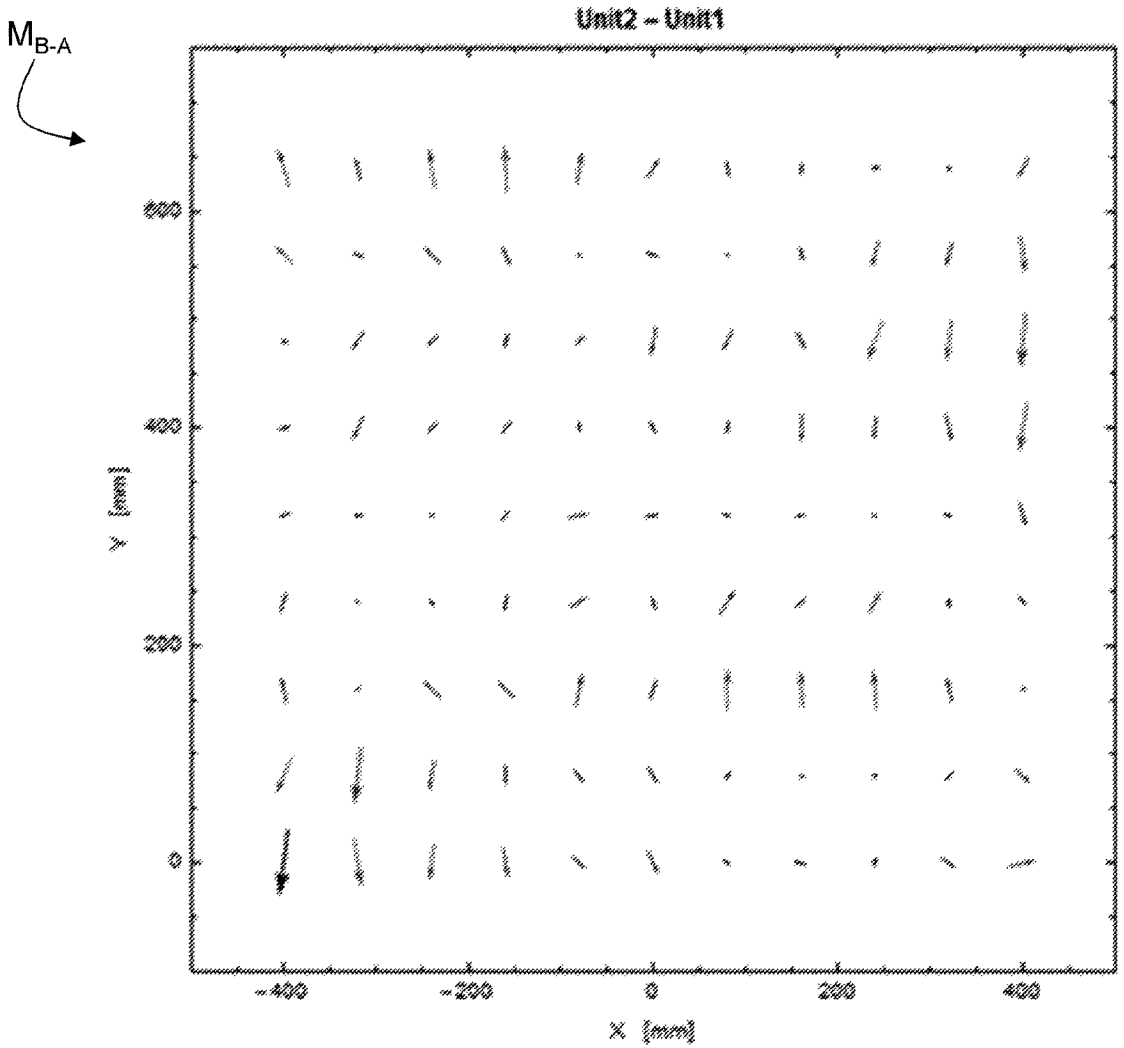
FIG. 22 is an illustrative example of a map of multiple print-to-print register measurements that have been carried in accordance with the invention at a plurality of imprint locations over the printed material.

As a result, one derives a representative map of the print-to-print register deviations all over the surface of the printed material. FIG. 22 for instance illustrates the result of a mapping of multiple print-to-print register measurements between first and second patterns A, B as performed in accordance with the aforementioned print-to-print register measurement principle. Each vector in FIG. 22 is representative of the measured x-y register deviation at each measured imprint location. The greater the amplitude of the vector, the greater the measured register deviation. In the present example, it is assumed for the sake of illustration that the first and second patterns A, B are printed by means of first and second printing plates PP of the printing press of FIGS. 1 and 2 (referred to in the map of FIG. 22 as "Unit 1" and "Unit 2"). The resulting print-to-print register map $M_{B-A}$ shown in FIG. 22 illustrates that register deviations over the surface of the sheets are typically non-uniform, with vectors pointing in different directions and exhibiting varying amplitudes. This emphasizes a huge advantage of the present invention, namely the fact that a more representative measurement of the distribution of print-to-print register deviations over the effective printed area can be derived, which opens up the possibility of carrying out a far more optimal plate correction operation, which is simply not possible when relying upon the use of dedicated print register marks or targets which are printed in margins outside the effective printed area of the printed material.

In the event that the multicolour print comprises more than two patterns (which is typically the case), the aforementioned process can easily be repeated in order to measure print-to-print register between a first pattern acting as reference pattern and each one of the other printed patterns forming the multicolour print. It is therefore possible to derive a corresponding print-to-print register map for each pair of patterns/plates (see for instance FIG. 23 where three such maps $M_{B-A}$, $M_{C-A}$ and $M_{D-A}$ are shown, it being assumed that the relevant multicolour print comprises four distinct patterns A to D in this instance).

Once the actual print-to-print register of the multicolour print is known or mapped, it is possible to determine a suitable plate correction of the relevant printing plate or plates used to print the multicolour print in order to minimize the misregister. This plate correction can for instance be used to correct a position of one or more printing plates in the relevant printing press or presses where these printing plates are mounted or to correct plate origination data used to produce the one or more printing plates.

Figure 23:
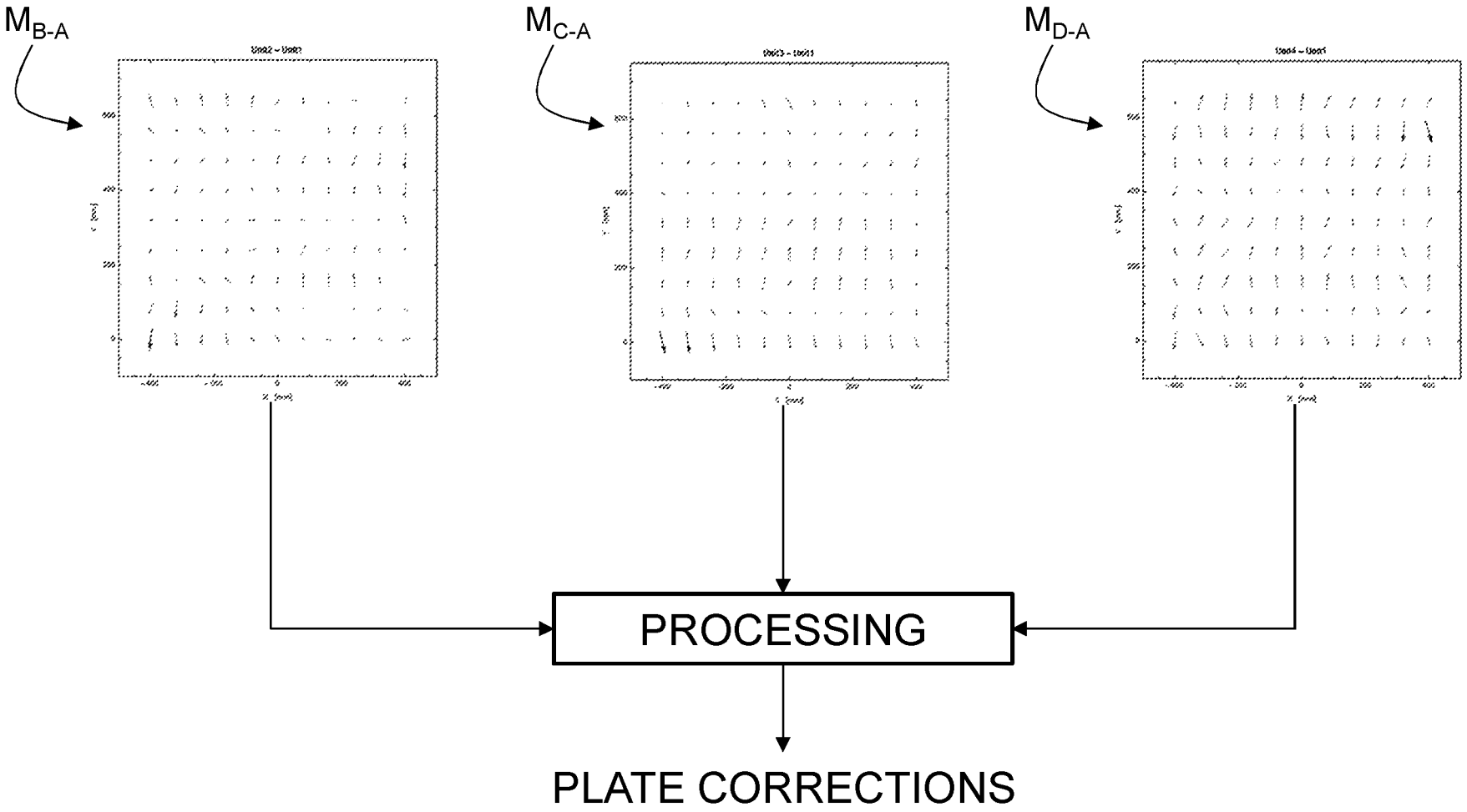
FIG. 23 schematically illustrates a process whereby measurements of the actual print-to-print register between multiple pairs of patterns are exploited and processed to compute corresponding plate corrections to adjust e.g. the positions of the relevant printing plates used to print the multicolour print.

In the particular context of the printing press of FIGS. 1 and 2, and assuming a multicolour print consisting of four distinct patterns A to D printed by means of all four printing plates PP on the recto or verso side, it suffices to map register deviations between three pairs of patterns, for instance between patterns A-B, A-C and A-D. In this case, pattern A is considered to be a "reference pattern", but any other pattern could be considered as a reference. In any event, in the present instance, three maps allow a complete mapping of print register deviations for all of the four printing plates PP ("Unit 1" to "Unit 4"). FIG. 23 shows three such print-to-print register maps $M_{B-A}$, $M_{C-A}$ and $M_{D-A}$ that can then be processed to optimize the print-to-print register over the entire sheet and derive corresponding plate corrections for the relevant printing plates PP as schematically illustrated in FIG. 23.

As far as the processing step is concerned, plate corrections could be computed according to any desired technique. For example, all relevant print-to-print register maps could be processed with a view to minimize the average print-to-print register deviations between all relevant pairs of patterns (e.g. pattern pairs B-A, C-A, D-A, C-B, D-B, D-C). It is however preferable to process the data with a view to bring the maximum print-to-print register deviation within desired tolerances, thereby ensuring that all imprints will meet desired print quality requirements and lead to no or a very limited rejection rate during print quality inspection.

The aforementioned plate corrections can accordingly be used to correct and adjust the position of the relevant printing plates, such as the printing plates PP of the printing press of FIGS. 1 and 2. In another context, the plate corrections could be used to correct plate origination data of the relevant printing plates used to produce the multicolour print. This may be the case for instance when optimizing the print-to-print register between patterns that are printed according to different printing techniques in separate printing presses, such as print-to-print register between an offset-printed pattern and an intaglio-printed pattern. In this case, plate origination data of the offset printing plate(s) or of the intaglio printing plate(s) could be corrected to reduce mismatch between the two printing phases.

The aforementioned plate corrections are obtained from processing the aforementioned print-to-print register maps (i.e. multiple sets of print-to-print register measurements). While plate corrections could in theory be derived from a single or a few print-to-print register measurements, it should be appreciated that a multiplicity of print-to-print register measurements distributed over the surface of the printed material ensures a more representative mapping of the actual print-to-print register and therefore allows computation of more optimal plate corrections.

In the aforementioned examples, the relevant images typically cover an area of the surface of the printed material of a few square millimetres. The images shown in the Figures are obviously illustrative and the dimensions and resolutions thereof are not limitative. These will be appropriately selected depending on the relevant patterns that are located in the region of interest. Furthermore, while FIGS. 16, 17, 19 and 20 show that the reference images are larger in dimensions than the sample images, the opposite could also be contemplated, in which case finding a correspondence between the images would involve finding a position of the relevant reference image within the sample image, rather than the opposite as described above.

Figure 24:
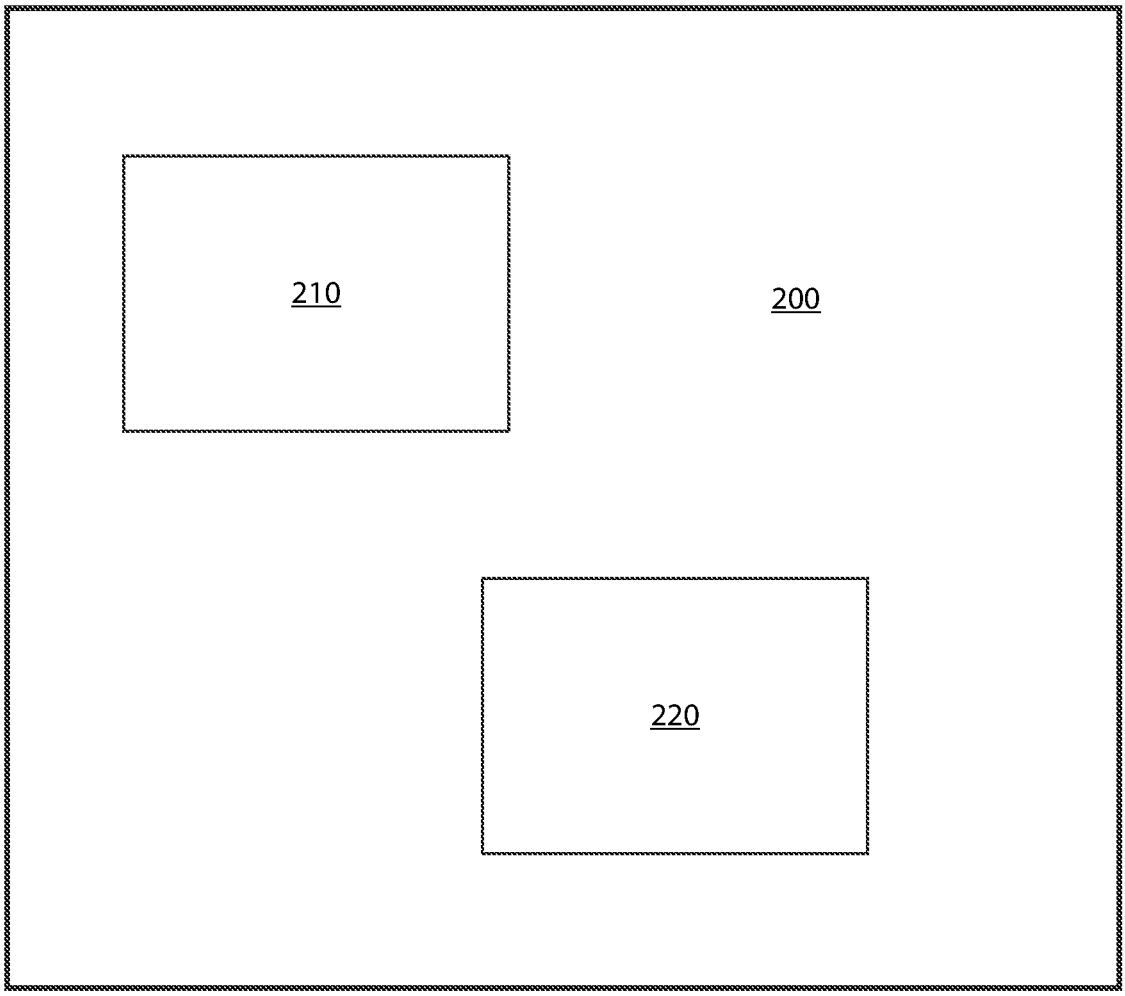
FIG. 24 schematically illustrates an exemplary measuring device with an image acquisition system and a processing system.

The aforementioned print-to-print register measurement principles can be embodied in a corresponding measuring device 200 comprising an image acquisition system 210 and a processing system 220 (see FIG. 24) designed to perform the relevant process steps. One example of a measuring device that could be modified to carry out the proposed measurement principles is disclosed in International (PCT) Publication No. WO 2012/131581 A1, which publication is incorporated herein by reference in its entirety.

Various modifications and/or improvements may be made to the above-described embodiments. In particular, while the embodiment discussed above have been described in the particular context of a sheet-fed offset printing press for simultaneous recto-verso printing of sheets as used for the production of security documents, the invention is equally applicable to any multicolour printing press of a type comprising multiple printing plates which are jointly used to form the multicolour print or in the context of the production of printed material that is subjected to multiple consecutive passes in different printing presses.

In addition, as this has already been mentioned, the present invention is applicable in order to measure, and possibly correct, the print-to-print register of a multicolour print that could be formed on only one or both sides of the printed substrate material. In other words, the "multicolour print" can be a single-sided multicolour print comprising patterns printed in register on only one side of the printed material (in which case the print-to-print register is understood to encompass print register deviations on one and a same side of the printed material) or a double-sided multicolour print comprising patterns printed in register on both sides of the printed material (in which case the print-to-print register is understood to encompass print register deviations on both sides and, potentially, between the recto and verso sides—i.e. "recto-verso register"—of the printed material).

Furthermore, while the preferred embodiment described above is based on a cross-correlation using two offset variables (i.e. x and y positions), cross-correlation could in effect be performed with more than two offset variables, including for instance variables representative of potential rotational shift of the relevant pattern.

LIST OF REFERENCE NUMERALS USED THEREIN

10 inking apparatus of printing press 100 (four inking apparatuses on the recto side)
20 inking apparatus of printing press 100 (four inking apparatuses on the verso side)
100 simultaneous recto-verso ("Simultan") offset printing press
101 printing group of printing press 100
102 sheet feeder group of printing press 100
103*a* sheet transfer cylinder (one-segment cylinder)
103*b* sheet transfer cylinder (two-segment cylinder)
103*c* sheet transfer cylinder (one-segment cylinder)
104 drying/curing unit
110 (first) blanket cylinder (three-segment cylinder)
115 (four) plate cylinders (one-segment cylinders)
120 (second) blanket cylinder (three-segment cylinder)
125 (four) plate cylinders (one-segment cylinders)
150 pair of side frames supporting blanket cylinders 110, 120
151 (first) mobile inking carriage supporting inking apparatuses 10
152 (second) mobile inking carriage supporting inking apparatuses 20
160 sheet transporting system (with spaced-apart gripper bars)
180 sheet delivery station
PP printing plate carried by plate cylinder 115, resp. 125
S printed sheet
EPA effective printed area on printed sheet S
P security (e.g. banknote) imprint within effective printed area EPA (which imprint is provided with a multicolour print)
L length of sheet S (typ. 700 mm)
W width of sheet S (typ. 820 mm)
L1 length of security imprint P (in the axial direction x)
L2 length of security imprint P (in the circumferential direction y)
P* portion of the multicolour print forming imprint P (FIG. 5)
A (first) printed pattern composing multicolour print of imprint P
B (second) printed pattern composing multicolour print of imprint P
C (third) printed pattern composing multicolour print of imprint P
D (fourth) printed pattern composing multicolour print of imprint P
RoI region of interest selected in portion P* of imprint P
$SI_A$ (first) sample image in the selected RoI where pattern A has been enhanced
$SI_B$ (second) sample image in the selected RoI where pattern B has been enhanced
$RI_A$ (first) reference image of pattern A for cross-correlation with sample image $SI_A$
$RI_B$ (second) reference image of pattern B for cross-correlation with sample image $SI_B$
$POS_A(x; y)$ positional information of the first pattern A derived from a cross-correlation of sample image $SI_A$ and reference image $RI_A$
$POS_B(x; y)$ positional information of the second pattern B derived from a cross-correlation of sample image $SI_B$ and reference image $RI_B$
$M_{B\text{-}A}$ print-to-print register map resulting from mapping of multiple print-to-print register measurements between patterns A and B at various imprint location over the effective printed area (EPA)
$M_{C\text{-}A}$ print-to-print register map resulting from mapping of multiple print-to-print register measurements between patterns A and C at various imprint location over the effective printed area (EPA)
$M_{D\text{-}A}$ print-to-print register map resulting from mapping of multiple print-to-print register measurements between patterns A and D at various imprint location over the effective printed area (EPA)

The invention claimed is:

1. A process of measuring a print-to-print register of a multicolour print provided in an effective printed area of a surface of a printed material, the multicolour print being formed on the printed material by way of a printing press and including at least a first pattern and a second pattern distinguishable from the first pattern, the process comprising:

forming the multicolour print on the printed material in several consecutive passes by way of multiple printing presses, the printed material being provided with a combination of printed patterns produced in accordance with different printing processes so that the multicolour print results from a combination of an offset-printed pattern and an intaglio-printed pattern;

providing a matrix arrangement of individual imprints with the multicolour print in the effective printed area, each imprint being repeated over the surface of the effective printed area along a pattern of rows and columns;

deriving a set of multiple measurements of an actual print-to-print register between the first and second patterns at various imprint locations over the effective printed area by repeating for multiple ones of the individual imprints processing and finding a correspondence between:

(i) at least one sample image of the printed material covering at least a portion of the first and second patterns; and (ii) at least one corresponding reference image generated using prepress design data of the first and second patterns;

mapping the set of multiple measurements into a corresponding print-to-print register map that is representative of print-to-print register deviations at the various imprint locations, wherein said correspondence between the at least one sample image and the at least one reference image is found by performing a cross-correlation between the at least one sample image and the at least one reference image, the cross-correlation including finding an optimum of a correlation function between the at least one sample image and the at least one reference image.

2. The process according to claim 1, further comprising the following steps:

a) producing at least one print sample of the printed material reflecting the actual print-to-print register between the first and second patterns;

b) selecting at least one region of interest on the at least one print sample, the selected at least one region of interest including at least a portion of the first pattern and at least a portion of the second pattern;

c) acquiring an image of the at least one print sample covering at least the selected at least one region of interest on the at least one print sample and processing the image of the at least one print sample to generate at least one sample image corresponding to the selected at least one region of interest;

d) generating at least one reference image of the first and second patterns in a region corresponding to the selected at least one region of interest using prepress design data of the first and second patterns, the at least one reference image reflecting a desired position of the first and second patterns;

e) for each one of the first and second patterns, finding a correspondence between the at least one sample image and the at least one reference image and extracting positional information from a result of the correspondence, the positional information being representative of an actual position of each one of the first and second patterns; and f) deriving a measurement of the actual print-to-print register between the first and second patterns in the at least one print sample based on the positional information of the first and second patterns extracted at step e).

3. The process according to claim 2, wherein step d) further comprises generating a separate reference image of each one of the first and second pattern including:

d1) generating a first reference image of the first pattern in the region corresponding to the selected at least one region of interest using prepress design data of the first pattern; and d2) generating a second reference image of the second pattern in the region corresponding to the selected at least one region of interest using prepress design data of the second pattern (B), and wherein step e) further comprises:

e1) finding a correspondence between the at least one sample image and the first reference image and extracting positional information from a result of the correspondence, the extracted positional information being representative of the actual position of the first pattern; and e2) finding a correspondence between the at least one sample image and the second reference image and extracting positional information from a result of the correspondence, the extracted positional information being representative of the actual position of the second pattern.

4. The process according to claim 3, wherein step c) further comprises:

c1) processing the image of the at least one print sample to generate a first sample image where the first pattern is enhanced; and c2) processing the image of the at least one print sample to generate a second sample image where the second pattern is enhanced, wherein the positional information of the first pattern is extracted at step e1) by finding a correspondence between the first sample image and the first reference image, and wherein the positional information of the second pattern is extracted at step e2) by finding a correspondence between the second sample image and the second reference image.

5. The process according to claim 2, wherein the processing of the image of the at least one print sample includes correcting orientation and/or scale of the image in order to match an expected orientation and/or scale of the first and second patterns.

6. The process according to claim 1, wherein the process is repeated for each one of the individual imprints so as to derive at least one measurement of the actual print-to-print register between the first and second patterns at each imprint location.

7. The process according to claim 1, wherein the multicolour print comprises more than two patterns and wherein the process is carried out in order to measure print-to-print register between multiple pairs of patterns.

8. A process of measuring and correcting print-to-print register of a multicolour print provided in an effective printed area of a surface of a printed material, the multicolour print being formed on the printed material by way of multiple printing presses and including at least a first pattern and a second pattern distinguishable from the first, wherein the effective printed area is provided with a matrix arrangement of individual imprints which are each provided with the multicolour print and are repeated over the surface of the effective printed area along a pattern of rows and columns, and wherein the process comprises the following steps:

(i) measuring a print-to-print register of the multicolour print in accordance with claim 1 to derive a set of multiple measurements of the actual print-to-print register between the first and second patterns at various imprint locations over the effective printed area, the set of multiple measurements being mapped into a corresponding print-to-print register map that is representative of print-to-print register deviations at the various imprint locations; and (ii) determining a plate correction of at least one printing plate used to print the multicolour print based on the print-to-print register map derived at step (i) in order to correct print-to-print register deviations between the first and second patterns, wherein said plate correction is determined at step (ii) so as to minimize an average print-to-print register deviation.

9. The process according to claim 8, wherein the plate correction is used to correct a position of the at least one printing plate in the relevant printing press.

10. The process according to claim 8, wherein the plate correction is used to correct plate origination data for the production of the at least one printing plate.

11. The process according to claim 8, wherein the multicolour print is formed using more than two printing plates and wherein the process is carried out in order to correct print-to-print register between multiple pairs of printing plates.

12. A measuring device to measure print-to-print register of a multicolour print provided in an effective printed area of the surface of printed material, the multicolour print is being formed on the printed material by way of multiple printing presses and including at least a first pattern and a second pattern distinguishable from the first pattern, the effective printed area being provided with a matrix arrangement of individual imprints which are each provided with the multicolour print and are repeated over the surface of the effective printed area along a pattern of rows and columns, wherein the measuring device comprises an image acquisition system and a processing system designed to perform the process of claim 1.

* * * * *